US008807050B2

(12) United States Patent
Aspengen et al.

(10) Patent No.: US 8,807,050 B2
(45) Date of Patent: Aug. 19, 2014

(54) RAILCAR CONSTANT CONTACT SIDE BEARING ASSEMBLY

(75) Inventors: Paul B. Aspengen, North Aurora, IL (US); Erik D. Jensen, Batavia, IL (US); Michael D. VanMaldegiam, North Aurora, IL (US); Adam J. Merges, Batavia, IL (US); Mark W. Stanek, Aurora, IL (US); Jeff Ballerini, Cortland, IL (US); Steve R. White, Maple Park, IL (US); Andy R. Kries, Elgin, IL (US)

(73) Assignee: Miner Enterprises, Inc., Geneva, IL (US)

( * ) Notice: Subject to any disclaimer, the term of this patent is extended or adjusted under 35 U.S.C. 154(b) by 231 days.

(21) Appl. No.: 13/507,145

(22) Filed: Jun. 7, 2012

(65) Prior Publication Data

US 2012/0291660 A1 Nov. 22, 2012

Related U.S. Application Data

(63) Continuation-in-part of application No. 12/460,416, filed on Jul. 17, 2009, now Pat. No. 8,201,504.

(51) Int. Cl.
*B61F 3/00* (2006.01)
*B61F 5/14* (2006.01)

(52) U.S. Cl.
CPC ..... *B61F 5/142* (2013.01)
USPC ..... 105/199.3

(58) Field of Classification Search
USPC ..... 105/182.1, 199.1, 199.3, 200, 211, 212, 105/213; 267/6, 292, 150, 153; 384/420, 384/423
See application file for complete search history.

(56) References Cited

U.S. PATENT DOCUMENTS

| | | | |
|---|---|---|---|
| 946,261 | A | 1/1910 | O'Connor |
| 1,179,755 | A | 4/1916 | Price et al. |
| 1,193,313 | A | 8/1916 | Townsend |
| 1,233,348 | A | 7/1917 | Hansson |
| 1,252,358 | A | 1/1918 | Miner |
| 1,290,319 | A | 1/1919 | O'Connor |
| 1,722,668 | A | 7/1929 | Lane |
| 1,808,839 | A | 6/1931 | Davis |

(Continued)

OTHER PUBLICATIONS

International Searching Authority; International Search report regarding PCT/US2010/1750; a9 Aug. 2010; 3 pages.

(Continued)

*Primary Examiner* — R. J. McCarry, Jr.
(74) *Attorney, Agent, or Firm* — Law Office of John W. Harbst

(57) ABSTRACT

A constant contact side bearing assembly for a railcar including a housing with wall structure defining a central axis for the side bearing assembly and a multipiece cap. The cap is arranged in operable combination with the housing and includes a movable first member or spring seat and a movable second member or top cap carried by the first member. A spring resiliently urges the cap members toward railcar body structure. The cap members define cooperating angled surfaces therebetween for urging wall structure on the first member and wall structure on the second member into frictional engagement with the wall structure on the housing in response to a vertical load acting on the friction contacting surface on the cap. At least the top cap is structured to establish a coefficient of friction ranging between about 0.4 and about 0.9 with the railcar during operation of the side bearing assembly.

21 Claims, 14 Drawing Sheets

(56) References Cited

U.S. PATENT DOCUMENTS

| | | | | | |
|---|---|---|---|---|---|
| 2,197,783 | A | | 4/1940 | Barrows | |
| 2,259,608 | A | | 10/1941 | Blattner | |
| 2,285,140 | A | | 6/1942 | Barrows et al. | |
| 2,541,769 | A | | 2/1951 | Keysor | |
| 2,571,190 | A | | 10/1951 | Blattner | |
| 2,636,789 | A | | 4/1953 | Blattner | |
| 2,830,857 | A | | 4/1958 | Blattner | |
| 3,151,918 | A | | 10/1964 | Bachman et al. | |
| 3,401,991 | A | | 9/1968 | McDonnell | |
| 3,514,169 | A | | 5/1970 | McDonnell | |
| 3,600,047 | A | | 8/1971 | McDonnell | |
| 4,924,779 | A | | 5/1990 | Curtis et al. | |
| 5,086,707 | A | | 2/1992 | Spencer et al. | |
| RE34,129 | E | * | 11/1992 | Wright | 384/423 |
| 5,315,934 | A | | 5/1994 | List | |
| 5,601,031 | A | | 2/1997 | Carlson | |
| 5,806,435 | A | * | 9/1998 | Pitchford | 105/199.3 |
| 6,092,470 | A | | 7/2000 | O'Donnell et al. | |
| 6,644,214 | B1 | | 11/2003 | Schoor | |
| 6,792,871 | B2 | | 9/2004 | O'Donnell et al. | |
| 6,957,611 | B2 | | 10/2005 | O'Donnell et al. | |
| 7,152,534 | B2 | | 12/2006 | O'Donnell et al. | |
| 7,275,487 | B2 | | 10/2007 | O'Donnell et al. | |
| 7,325,499 | B2 | | 2/2008 | Jensen et al. | |
| 7,338,034 | B2 | | 3/2008 | Aspengren et al. | |
| 7,784,410 | B2 | | 8/2010 | O'Donnell et al. | |
| 7,802,524 | B1 | | 9/2010 | Gregar | |
| 8,201,504 | B2 | | 6/2012 | O'Donnell et al. | |
| 2006/0117985 | A1 | | 6/2006 | Forbes et al. | |
| 2009/0308276 | A1 | | 12/2009 | Aitken et al. | |

OTHER PUBLICATIONS

International Searching Authority; Written opinion of the International Searching Authority regarding PCT/US2010/01750; Aug. 19, 2010; 8 pages.

* cited by examiner

RAILCAR CONSTANT CONTACT SIDE BEARING ASSEMBLY

RELATED APPLICATION

This application is a Continuation-In-Part of coassigned U.S. patent application Ser. No. 12/460,416; filed on Jul. 17, 2009, now U.S. Pat. No. 8,201,504.

FIELD OF THE INVENTION DISCLOSURE

The present invention disclosure generally relates to railroad cars and, more specifically, to a constant contact side bearing assembly for a railroad car.

BACKGROUND

A typical railroad freight car includes a car body supported on a pair of wheeled trucks which are confined to roll on rails or tracks. Each truck includes a bolster extending essentially transversely of the car body longitudinal centerline. In the preponderance of freight cars, a pivotal connection is established between the bolster and railcar body by center bearing plates and bowls transversely centered on the car body underframe and the truck bolster. Accordingly, the truck is permitted to pivot on the center bearing plates under the car body. As the railcar moves between locations, the car body also tends to adversely roll from side to side.

Attempts have been made to control the adverse roll of the railcar body through use of side bearings positioned on the truck bolster outwardly of the center bearing plates. A "gap style" side bearing has been known to be used on slower moving tank/hopper railcars. Conventional "gap style" side bearings include a metal, i.e. steel, block or pad accommodated within an elongated open top pocket or recess defined on the truck bolster. An elongated and upstanding housing or cage, integrally formed with or secured, as by welding or the like, to an upper surface on the truck bolster defines the open top recess and inhibits sliding movement of the metal block relative to the bolster. As is known, a gap or vertical space is usually present between the upper surface of the "gap style" side bearing and the underside of the railcar body.

Other conventional "gap style" side bearings have included roller bearings carried for rolling movements within the elongated housing or carrier mounted on the upper surface of the railcar bolster. The roller extends above an uppermost extent of the housing or carrier and engages with an underside of the railcar body. Such side bearings are able to support the railcar body with respect to the bolster while at the same time permitting the bolster, and therefore the truck, freedom to rotate with respect to the car body as is necessary to accommodate normal truck movements along both straight and curved track.

Under certain dynamic conditions, coupled with lateral track irregularities, the railcar truck also tends to adversely oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and truck. Excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continue to increase. Increased rail speeds translate into corresponding increases in the amount of hunting movements of the wheeled trucks. "Gap style" or those side bearings including roller bearings simply cannot and do not limit hunting movements of the wheeled trucks. As such, the truck components including the wheels, bolsters, and related equipment tend to experience premature wear.

The art has also contemplated constant contact side bearings for railcars. Constant contact railcar side bearings not only support a railcar body with respect to the bolster during relative rotational movements therebetween but additionally serve to dissipate energy through frictional engagement between the underside of the railcar body and a bearing element thereby limiting destructive truck hunting movements. Constant contact side bearings typically include a housing assembly including a base and a cap. The base usually has a cup-like configuration and includes at least two apertured flanges, extending in opposed radial directions relative to each other, permitting the base to be suitably fastened to the bolster. In one form, the cap is biased from the base and includes an upper surface for contacting and rubbing against a car body underside. The cap must be free to vertically move relative to the side bearing base.

Such constant contact side bearings furthermore include a spring. The purpose of such spring is to absorb, dissipate, and return energy imparted thereto during a work cycle of the side bearing assembly and resiliently position the upper surface of the cap, under a preload force, into frictional contact with the car body underframe. The spring for such side bearings can comprise either spring loaded steel elements or elastomeric blocks or a combination of both operably positioned between the side bearing base and the cap. An elastomeric block which has been found particularly beneficial is marketed and sold by the Assignee of the present invention under the tradename "TecsPak." As will be appreciated, however, such an elastomeric block, by itself, lacks longitudinal stiffness and, thus, requires surrounding housing structure to provide added support and stiffness thereto.

There are several challenges presented in connection with the design of a constant contact side bearing assembly. First, and during the course of operation, the clearance between the base and cap of a constant contact side bearing housing assembly becomes enlarged due to abrasion and wear. Such wear is a critical detractor to side bearing assembly performance. That is, any gap or space between the base and cap of the side bearing housing assembly adversely permits longitudinal or horizontal shifting movements of the cap relative to the housing thereby reducing the energy absorption capability for the side bearing assembly—a critical operating criteria for the side bearing assembly. Of course, if the gap or space between the base and cap of the side bearing housing assembly reaches a critical limit, the side bearing assembly is no longer useful and will be condemned.

During operation of the railcar side bearing assembly, and while controlling any clearance or gap between the cap and housing of the side bearing assembly so as to limit horizontal shifting movements of the cap relative to the housing remains advantageous, the cap must remain able to vertically reciprocate relative to the housing. As will be appreciated, if the cap cannot vertically reciprocate during operation of the side bearing assembly, the primary purpose and function of the constant contact side bearing assembly will be lost.

Another design challenge involved with those constant contact side bearings using an elastomeric spring relates to the buildup of heat in proximity to the elastomeric spring. During operation of the railcar, frictional contact between the railcar body and the side bearing assembly results in the development of heat buildup. Unless such heat buildup can be controlled, the elastomeric spring will tend to soften and deform, thus, adversely affecting the operable performance of the constant contact side bearing assembly.

The frictional sliding relationship between the side bearing assembly and the related railcar component can create temperatures within the side bearing assembly that can exceed the heat deflection temperature of the elastomeric spring thus causing the elastomeric spring to deform. As used herein and throughout, the term "heat deflection temperature" means and refers to a temperature level at the which the elastomeric spring, regardless of its composition, tends to soften and deform. Deformation of the elastomeric spring can significantly reduce the ability of the elastomeric spring to apply a proper preload force and, thus, decreases vertical suspension characteristics of the side bearing assembly which, in turn, results in enhanced hunting of the wheeled truck. Enhanced hunting and/or unstable cyclic yawing of the truck increases the resultant translation/oscillation of the railcar leading to a further increase in the heat buildup and further deterioration of the elastomeric spring.

Thus, there is a continuing need and desire for a railcar constant contact side bearing assembly having components which are designed to optimize energy absorption and related performance criteria for the side bearing assembly while maintaining vertical reciprocity of the cap relative to the housing and furthermore inhibiting deterioration of an elastomeric spring resulting from localized heat.

SUMMARY

According to one aspect, there is provided a constant contact side bearing assembly for a railcar including a housing and a multipiece cap arranged in operable combination with each other. The side bearing assembly housing includes upstanding wall structure defining a central axis for the side bearing assembly. The multipiece cap includes a first non-metal member arranged within the housing and having generally vertical wall structure arranged to slidably contact the wall structure of the housing arranged to one side of the central axis during operation of the side bearing assembly. The multipiece cap further includes a second non-metal member arranged at least partially within the housing and carried by the first member. The second cap member includes generally vertical wall structure arranged to slidably contact the wall structure of the side bearing housing arranged to an opposite or second side of the central axis of the side bearing assembly during operation of the side bearing assembly. A generally flat surface on the second member extends beyond the wall structure of the housing. A spring is arranged within the housing and is generally centralized beneath both the first and second members of the multipiece cap for returning energy imparted to the spring during operation of the side bearing assembly. The members of the multipiece cap define non-vertical interengaging and slidable surfaces therebetween which are disposed at an angle ranging between about 20 degrees and about 30 degrees relative to a horizontal plane for maintaining the generally vertical wall structure on each cap member in sliding contact with the wall structure of the housing thereby limiting horizontal shifting movements of the multipiece cap relative to the housing while maintaining vertical reciprocity of the cap members relative to the housing. An insert is maintained in operable association with the generally flat surface of the second non-metal member of the cap to slidably contact with an underside of the railcar whereby allowing the side bearing assembly to establish a coefficient of friction ranging between about 0.4 and about 0.9 with the railcar during operation of the side bearing assembly.

Preferably, the insert maintained in operable association with the second non-metal cap member is formed from a metal selected from the class of steel and austempered ductile iron. In one form, the housing and multipiece cap define cooperating instrumentalities for guiding the first and second members for vertical reciprocatory movements relative to the housing and for maintaining a predetermined relation between the first and second members and the housing.

In one embodiment, the spring for the constant contact side bearing assembly includes an elastomeric member. Preferably, the constant contact side bearing assembly housing includes a base with generally horizontal flange portions extending in opposite directions and away from the central axis of the side bearing assembly. To facilitate securement of the side bearing assembly to a railcar bolster, each flange portion defines an aperture therein.

According to another aspect, there is provided a constant contact side bearing assembly for a railcar including a housing and a multipiece cap arranged in operable combination with each other. The housing includes generally vertical wall structure and defines a central axis for the side bearing assembly. The multipiece cap includes a first plastic member arranged within the housing and a second plastic member arranged at least partially within the housing and carried by the first member. A portion of the second member extends beyond the housing and defines a generally flat surface. A spring is arranged within the housing for returning energy imparted to the side bearing assembly. The multipiece cap members define cooperating angled surfaces disposed at an angle of about 20 degrees and about 30 degrees relative to a horizontal plane for urging and maintaining the generally vertical wall structure on each cap member in sliding engagement with the wall structure of the housing while maintaining vertical reciprocity movements of both cap members relative to the housing during operation of the side bearing assembly. An insert is maintained in operable association with the generally flat surface on the second member for contacting an underside of the railcar so as to establish a coefficient of friction ranging between about 0.4 and about 0.9 with the railcar during operation of the side bearing assembly Preferably, the insert on the second plastic member is formed from a metal from the class of: steel and austempered ductile iron. In one form, the spring includes an elastomeric member having first and second axially aligned ends. In this embodiment, the base of the side bearing assembly housing supports one end of the spring. In one embodiment, the side bearing assembly housing and at least one member of the multipiece cap define cooperating instrumentalities for guiding the cap members for vertical reciprocatory movements relative to the housing and for maintaining a predetermined relation between the cap members and the housing.

According to another aspect, there is provided a constant contact side bearing assembly for a railcar including a housing, a non-metal spring seat and a non-metal top cap arranged in operable combination relative to each other. The side bearing assembly housing has generally vertical wall structure defining a central axis for the side bearing assembly. The non-metal spring seat is arranged within the housing for vertical reciprocatory movement. The non-metal top cap is at least partially arranged with the housing for vertical reciprocatory movement. The top cap has a generally flat surface spaced at least partially above the wall structure of the housing. The top cap is carried by the spring seat. A spring is arranged within the housing for returning energy imparted to the side bearing assembly. The spring seat and top cap define cooperating angled surfaces therebetween for urging the spring seat and top cap in opposed directions away from the central axis of the side bearing assembly such that non-metal wall structure, on each of the spring seat and top cap, is moved into sliding engagement with the wall structure on the housing in response to a vertical load acting on the side bearing assembly while maintaining vertical reciprocity of the spring seat and top cap relative to the housing. To allow the side bearing assembly to establish a coefficient of friction ranging between about 0.4 and about 0.9 with the railcar during operation of the side bearing assembly, an insert is maintained in operable association with and is generally centered on the flat surface of the top cap.

In one form, the insert maintained in operable association with the plastic top cap is formed from metal selected from the class of: steel and austempered ductile iron. Alternatively, the insert maintained in operable association with the plastic top cap is formed from a composite material capable of establishing a coefficient of friction ranging between about 0.4 and about 0.9 with an underside of the railcar during operation of the side bearing assembly.

Preferably, the spring for the side bearing assembly includes an elastomeric member. In one embodiment, the side bearing assembly housing and at least one of the spring seat and top cap define cooperating instrumentalities for guiding said spring seat and top cap for vertical reciprocatory movements relative to the housing and for maintaining a predetermined relation between the cap members and the housing.

In yet another embodiment, there is provided a constant contact side bearing assembly for a railcar including a housing, a spring seat and a top cap arranged in operable combination relative to each other. The side bearing assembly housing has generally vertical wall structure defining a central axis for the side bearing assembly. The wall structure of the housing defines a first generally vertical sliding surface. The spring seat is arranged within the housing. The top cap is at least partially arranged with the housing. The top cap has a plate portion spaced at least partially above the wall structure of the housing so as to define a friction surface for the side bearing assembly. The top cap is carried by the spring seat. A spring is arranged within the housing for resiliently urging the friction surface on the top cap into friction sliding contact with a part of the railcar. The spring seat and top cap define cooperating angled surfaces therebetween for urging the spring seat and top cap in opposed directions away from the central axis of the side bearing assembly and such that second and third generally vertical sliding surfaces defined by the wall structures of the spring seat and top cap are moved into and maintained in sliding engagement with the first sliding surface on the wall structure of the housing in response to vertical loads acting on the side bearing assembly. Structure is provided between the first sliding surface on the wall structure of the housing and each sliding surface on the wall structures of the spring seat and top cap to inhibit binding and promote vertical reciprocatory movements of the spring seat and top cap relative to said housing during operation of said side bearing assembly.

In one form, the structure between the sliding surface on the wall structure of the housing and each sliding surface on the wall structures of the spring seat and top cap includes at least one non-metal insert carried by at least one of the sliding surface on the wall structure of the housing and each sliding surface on the wall structure of each spring seat and top cap. Alternatively, the structure provided between the sliding surface on the wall structure of the housing and each sliding surface on the wall structures of the spring seat and top cap includes a non-metallic sleeve. In another form, the structure provided between the sliding surface on the wall structure of the housing and each sliding surface on the wall structures of the spring seat and top cap includes a non-metallic coating to inhibit binding and promote vertical reciprocatory movements of the spring seat and top cap relative to the housing during operation of said side bearing assembly.

Preferably, the spring for the side bearing assembly includes an elastomeric member. In one embodiment, the side bearing assembly housing and at least one of the spring seat and top cap define cooperating instrumentalities for guiding said spring seat and top cap for vertical reciprocatory movements relative to the housing and for maintaining a predetermined relation between the cap members and the housing.

DETAILED DESCRIPTION

Figure 1:
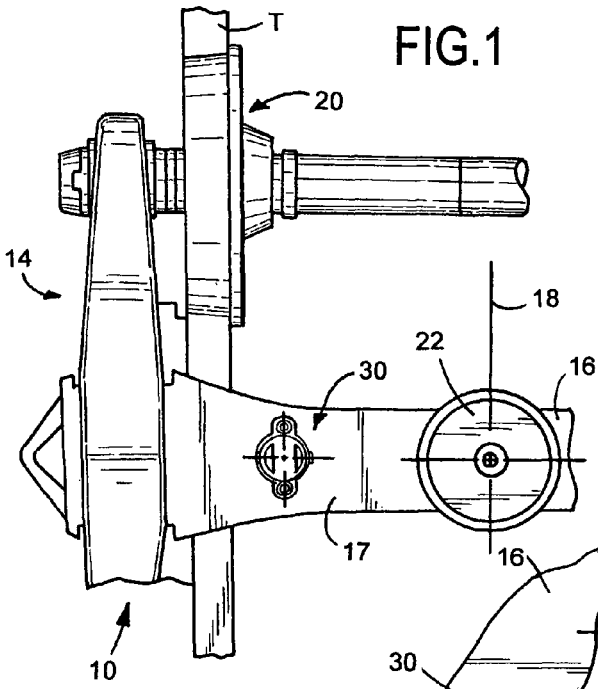
FIG. 1 is a top plan view of a portion of a railroad car wheeled truck including one form of a constant contact side bearing assembly embodying principals of this invention disclosure.

While this invention disclosure is susceptible of embodiment in multiple forms, there is shown in the drawings and will hereinafter be described preferred embodiments of this invention disclosure, with the understanding the present disclosure is to be considered as setting forth exemplifications of the disclosure which are not intended to limit the disclosure to the specific embodiment illustrated and described.

Referring now to the drawings, wherein like reference numerals indicate like parts throughout the several views, FIG. 1 shows a fragment of a railcar wheeled truck assembly, generally indicated by reference numeral 10, for supporting and allowing a railcar body 12 defining a part of a railcar 13 (FIG. 3) to ride along and over tracks T. Truck assembly 10 is of a conventional design and includes a side frame 14, a bolster 16, extending generally transversely relative to a longitudinal centerline 18 of the railcar body 12 (FIG. 3), and a wheel set 20. A conventional center bearing plate 22 is suitably mounted on the bolster 16 for pivotally supporting one end of the car body 12 (FIG. 3).

A railroad car side bearing assembly embodying principals of this invention disclosure is generally indicated in FIG. 1 by reference numeral 30 and is arranged in operable combination with each wheeled truck assembly 10. More specifically, and as is conventional, a railroad car side bearing assembly is mounted on an upper surface 17 of the railcar bolster 16 on opposite lateral sides of the center bearing plate 22 to limit hunting movements and oscillation of the wheeled truck assembly 10 as the railcar moves over the tracks T.

Figure 2:
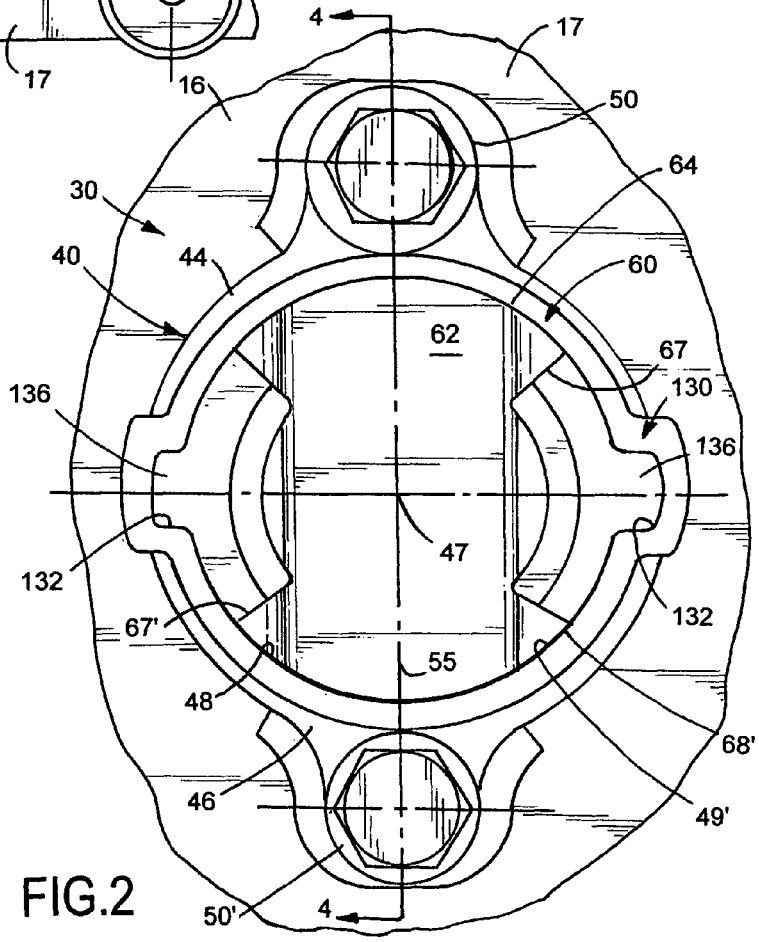
FIG. 2 is an enlarged top plan view of the constant contact side bearing assembly illustrated in FIG. 1.

The aesthetic design of the side bearing assembly 30 illustrated in the drawings is merely for exemplary purposes. Whereas, the principals and teachings set forth below are equally applicable to other side bearings having different forms and shapes. Turning to FIG. 2, side bearing assembly 30 includes a housing or cage 40, a multipiece cap 60 arranged for generally telescoping or vertical reciprocatory movements relative to the housing 40, and a spring 100 (FIG. 4).

Figure 3:
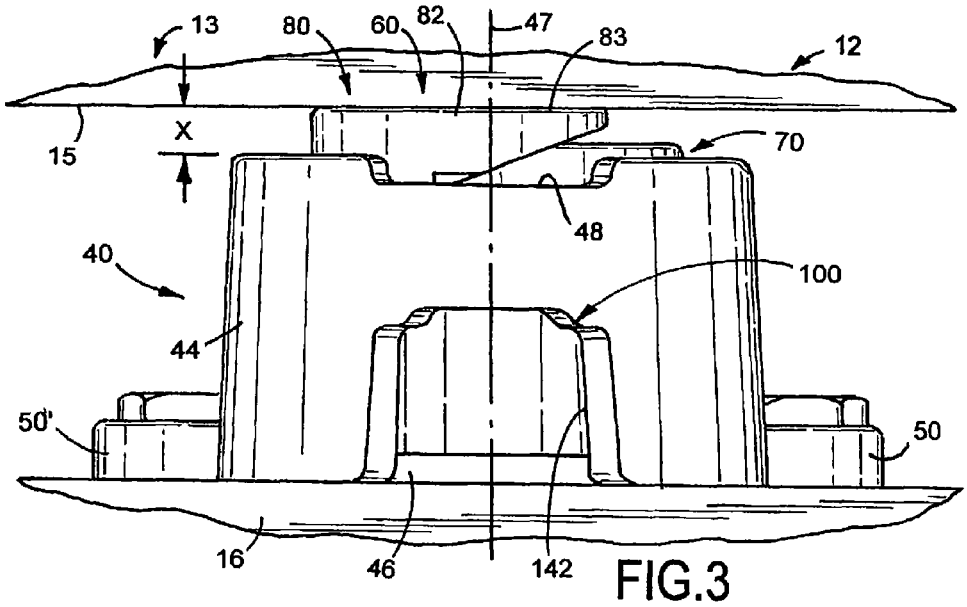
FIG. 3 is a side elevational view of the constant contact side bearing assembly illustrated in FIG. 2.
Figure 4:
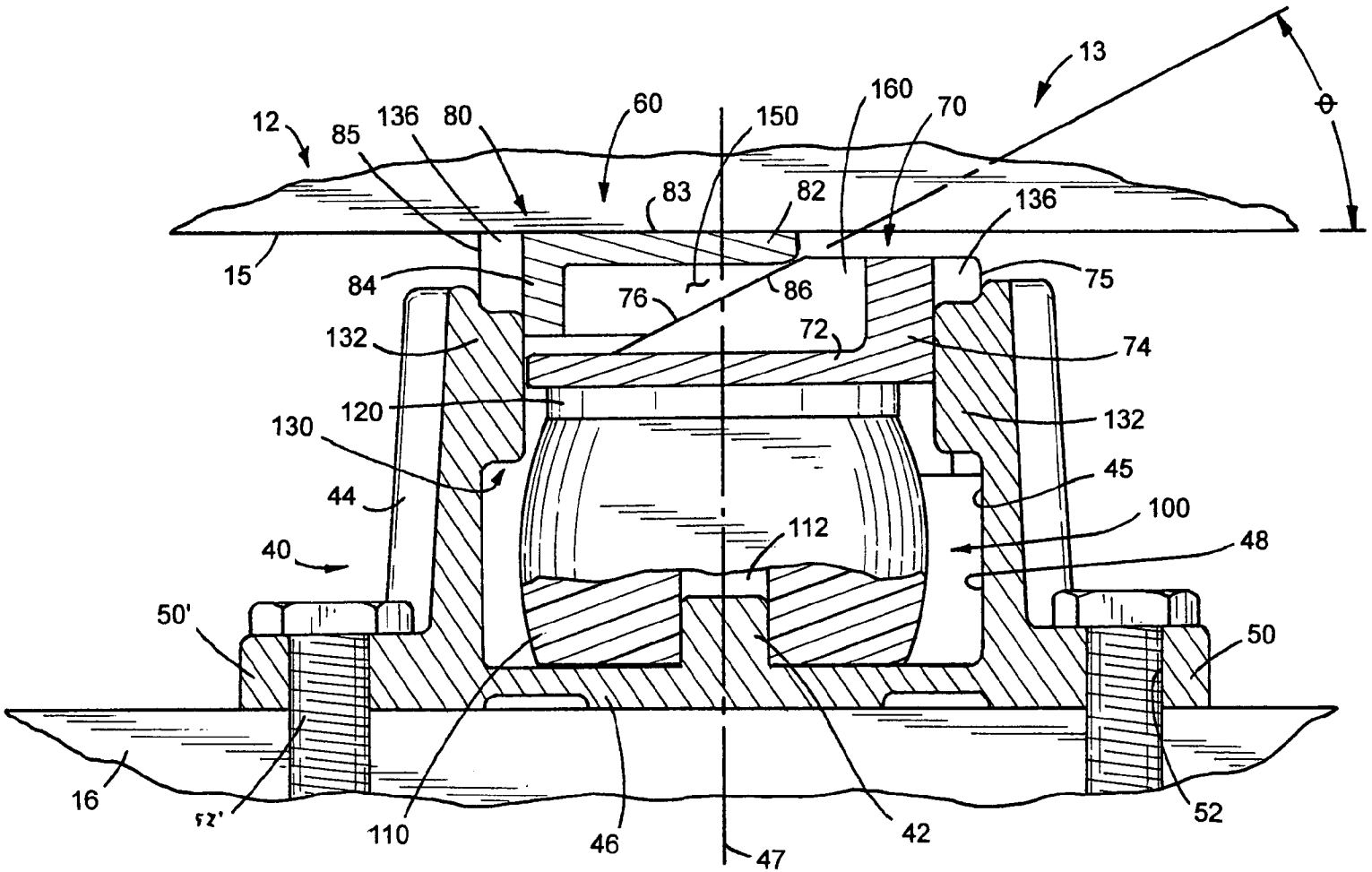
FIG. 4 is an enlarged sectional view taken along line 4-4 of FIG. 2.

In the embodiment shown in FIGS. 2, 3 and 4, housing 40 is preferably formed of a strong and wear resistant metal material, such as steel or the like, and includes wall structure 44 extending upwardly from a base 46 to define an axis 47 for the side bearing assembly 30. The housing wall structure 44 extends upwardly from the base 46 for a predetermined distance. The wall structure 44 of the side bearing housing 40 defines an open-top cavity or internal void 48 having a predetermined inner surface configuration.

The housing base 46 is configured for suitable attachment to an upper surface 17 of the railcar bolster 16 as through any suitable means, i.e. threaded bolts or the like. In the illustrated embodiment, housing base 46 includes a pair of mounting flanges 50 and 50' radially extending outwardly in opposed directions away from the side bearing assembly axis 47. Each mounting flange 50, 50' defines a bore or aperture 52, 52' (FIG. 4), respectively, for allowing a suitable fastener to extend therethrough whereby permitting the housing 40 to be fastened to the upper surface 17 of the bolster 16. Preferably, the bores or apertures 52, 52' are aligned relative to each other along a longitudinal axis 54 such that, when housing 40 is secured to the bolster 16, axis 54 extends generally parallel to the longitudinal axis 18 of car body 12.

The multipiece cap 60 for the side bearing assembly 30 includes a first member or spring seat 70 and a second member or top cap 80 arranged in operable combination relative to each other. In the embodiment illustrated in FIGS. 2, 3 and 4, both cap members 70 and 80 are preferably made from a strong and wear resistant metal material such as steel or the like. As shown in FIG. 4, the spring seat 70 is positioned within the housing 40 for generally vertical movements and includes a generally horizontal bed or supporting plate 72 and generally vertical wall structure 74. When arranged within the side bearing housing 40, the wall structure 74 of member 70 is arranged to one side of the vertical axis 47 of the side bearing assembly 30. Preferably, wall structure 74 is formed integral with the supporting plate 72. Notably, and as shown in FIGS. 2 and 4, an outer surface 75 on the upstanding wall structure 74 complements the inner surface 45 of the side bearing housing wall structure 44 arranged to one side of the vertical axis 47 of the side bearing assembly 30. In the embodiment illustrated for exemplary purposes, side bearing housing inner surface 45 and the spring seat outer wall surface 75 each have a curved surface configuration which complement each other and promote sliding movement therebetween.

As shown in FIG. 2, the second member 80 is at least partially positioned within the housing 40 for generally vertical movements and is operably carried by the first member 70. Member 80 desirably includes a generally horizontal plate 82 defining an upper generally planar surface 83 which is adapted to frictionally engage and slide relative to an underside 15 of the car body 12 (FIG. 2). When the side bearing assembly 30 is secured to the bolster 16, at least a portion of the planar surface 83 of member 80 is disposed above a terminal end of the upstanding wall structure 44 of the side bearing housing for a predetermined distance. In the example shown, the normal distance between surface 83 of member 80 and the top edge of the wall structure 44, indicated by the distance "X" in FIG. 3, is determinative of the permissible compressive movement of the side bearing assembly 30 and such that after the underside 15 of the railcar body 12 contacts the upper edge of the housing structure 44, the side bearing assembly 30 functions as a solid unit and will prevent further rocking and relative movement between the bolster 16 and the railcar body 12.

As shown, member 80 furthermore includes generally vertical wall structure 84 which, when cap member 80 is assembled in operable relation with the side bearing assembly 30, is disposed to an opposite side of the axis 47 from the wall structure 74 of cap member 70. Preferably, wall structure 84 of cap member 80 is formed integral with plate 82. As shown in FIGS. 2 and 4, an outer surface 85 on wall structure 84 complements the inner surface 45 on the housing wall structure 44 disposed to an opposed side of the vertical axis 47 of the side bearing assembly 30 from surface 75 of member 70. In the embodiment illustrated for exemplary purposes, the inner surface 45 on the housing wall structure 44 and the wall structure outer surface 85 on cap member 80 each have a curved surface configuration which complement each other and promote sliding movement therebetween.

One of the salient aspects of this invention disclosure relates to the ability to limit—if not eliminate—horizontal shifting movements of the side bearing assembly cap 60 relative to the side bearing assembly housing 40 whereby significantly enhancing operating characteristics and performance of the side bearing assembly 30. To accomplish this desired end, and as illustrated in FIG. 4, the first and second members 70 and 80 of the multipiece cap 60 define non-vertical interengaging and slidable surfaces 76 and 86, respectively, therebetween for maintaining the outer surfaces 75 and 85 of members 70 and 80, respectively, in frictional sliding contact with the inner surface 45 of the side bearing housing 40. That is, and in response to a vertical load being directed against the side bearing assembly 30, the cooperating angled surfaces 76 and 86 defined by the respective first and second members 70 and 80 of the multipiece cap 60 urge the spring seat 70 and member 60 in opposite directions relative to each other and away from the centerline or upstanding axis 47 of the side bearing assembly 30 such that the outer surfaces 75 and 85 on each of the first and second member 70 and 80, respectively, are constantly urged toward and maintained in sliding engagement with the inner surface 45 of the side bearing housing 40.

In one form, the non-vertical surfaces 76 and 86 of the first and second members 70 and 80, respectively, of the multipiece side bearing assembly cap 60 are disposed at a predetermined angle θ. In one form, the predetermined angle θ ranges between about 20° and about 30° relative to a horizontal plane. In a most preferred form, the cooperating angled surfaces 76 and 86 between the first and second members 70 and 80, respectively, of cap 60 are disposed at an angle of about 25° relative to a horizontal plane.

Since the side bearing assembly 30 of the present disclosure is of a resilient type, it is essential some form of yieldable apparatus be incorporated therein. In this regard, spring 100 is arranged in operable combination with and for absorbing, dissipating and returning energy imparted to the multipiece cap 60. As shown, spring 100 is arranged and accommodated within the cavity 48 defined by housing 40.

Like the overall side bearing design, the exact shape or form of the spring 100 can vary or be different from that illustrated for exemplary purposes without detracting or departing from either the spirit or scope of this invention disclosure. In the embodiment illustrated in FIG. 4, spring 100 is comprised of a formed and resiliently deformable thermoplastic elastomer member 110 and, preferably, a thermal insulator 120.

In the embodiment illustrated for exemplary purposes in FIG. 4, member 110 of spring 100 has a configuration suitable for accommodation between base 46 of the side bearing housing 40 and an underside of the support plate 72 of the spring seat 70. Member 110, illustrated by way of example in FIG. 4, preferably embodies the teachings set forth in coassigned U.S. Pat. No. 7,338,034; the applicable portions of which are incorporated herein by reference. In the illustrated embodiment, member 110 defines a generally centralized bore 112 opening to axially aligned ends of member 110. It should be appreciated, however, member 110 could also be solidly configured. Suffice it to say, the thermoplastic member 110 preferably has an elastic strain to plastic strain ratio of about 1.5 to 1. Coassigned U.S. Pat. No. 4,198,037 to D. G. Anderson, the applicable portions of which are incorporated hereby by reference, better describes the composition and methodology for forming member 110.

The thermal insulator 120 of spring 100 is preferably arranged at one end of and is intended to operably protect the thermoplastic member 110 from the adverse affects of heat generated by the sliding frictional movements between the underside 15 of the railcar body 12 (FIG. 3) and the planar surface 83 on the side bearing cap 60 during movements of the railcar between locations. Suffice it to say, and in the illustrated embodiment, the thermal insulator 120 is operably carried at one end of the thermoplastic member 110 and is preferably of the type disclosed in coassigned U.S. Pat. Nos. 6,092,470; 6,892,999; and 7,044,061; the applicable portions of which are incorporated herein by reference.

In the embodiment illustrated for exemplary purposes in FIG. 4, the base 46 of the side bearing assembly 40 supports that end of the spring 100 opposite from the thermal insulator 120. Preferably, a spring guide or projection 42 is provided and is centrally located on the base 46 of the side bearing housing 40. In the illustrated embodiment, the spring guide 42 fits within the bore or recess 112 defined by member 110 whereby operably locating at least the lower end of the spring 100 within the side bearing assembly housing 40.

Returning to FIG. 2, the side bearing housing 40 along with at least one of the first and second members 70 and 80 of the multipiece cap 60 define cooperating instrumentalities 130 for guiding the members of cap 60 for vertical reciprocatory movements relative to the housing 40 and for maintaining a predetermined relation between the cap 60 and the side bearing housing 40. As shown in FIG. 2, the interior surface 45 of the side bearing housing 40 preferably defines a pair of vertically extending splines or keys 132 which, in the illustrated embodiment, are positioned in diametrically opposed relation from each other. Each spline or key 132 extends along the interior surface 45 of the side bearing housing 40 for a vertical distance which is sufficient to accommodate and guide vertical reciprocatory movements of at least one member 70, 80 of the side bearing cap 60 during operation of the side bearing assembly 30.

Preferably, in the embodiment illustrated in FIG. 2, the splines or keyway 132 are formed integral with the housing 40 and are disposed in general alignment with the longitudinal axis 54 defined by the side bearing housing 40. Moreover, and in a preferred form, each member 70, 80 of the multipiece cap 60 defines a recessed cutout or keyway 136 which is configured to receive a mating spline or key 132 on the side bearing housing 40 whereby guiding each member 70, 80 for vertical reciprocatory movements relative to the housing 40 while maintaining a predetermined relation between the members 70, 80 and the side bearing housing 40.

In the embodiment illustrated for exemplary purposes, the side bearing assembly 30 is configured to promote the dissipation of heat from the cavity 48 and away from the thermoplastic spring 100 thereby prolonging the usefulness of the side bearing assembly 30. As shown in FIGS. 2 and 3, the wall structure 44 of the side bearing housing 40 preferably defines openings 140 and 142 disposed to opposite lateral sides of the longitudinal axis 47 of the side bearing housing 40. In one form, openings 140 and 142 are disposed toward a lower end of the side bearing housing 40 in a vicinity of an intersection between wall structure 44 and base 46. In the illustrated embodiment, the openings 140 and 142 are generally aligned along a line extending generally perpendicular or normal to the longitudinal axis 47 of housing 40. As will be appreciated, the openings 140 and 142 provide a particular advantage when a thermoplastic spring is used to resiliently urge the cap 60 against and into frictional sliding contact with an underside 15 of the railcar body 12 (FIG. 2).

The multipiece cap 60 of the side bearing assembly 30 is furthermore preferably designed to reduce the adverse affects of heat on the thermoplastic spring 100 during operation of the side bearing assembly 30. More specifically, in the embodiment illustrated in FIG. 4, member 80 of the multipiece cap 60 includes a passage 150 for directing air preferably beneath the planar surface 83 of cap 60 whereby inhibiting conductive heat transfer from plate 82 to that end of the thermoplastic spring assembly 100 arranged proximate to member 80. Similarly, and in the embodiment illustrated in FIG. 4, member 70 of the multipiece cap 60 includes a passage 160 arranged in operable combination with passage 150 in member 80 for directing air between the upper frictional surface 83 of cap 60 and the adjacent end of the spring 100. The passage 150 and 160 in the cap structure 60 provides a particular advantage when a thermoplastic spring is used to resiliently urge the cap 60 against and into frictional sliding contact with an underside 15 of the railcar body 12 (FIG. 4).

Figure 5:
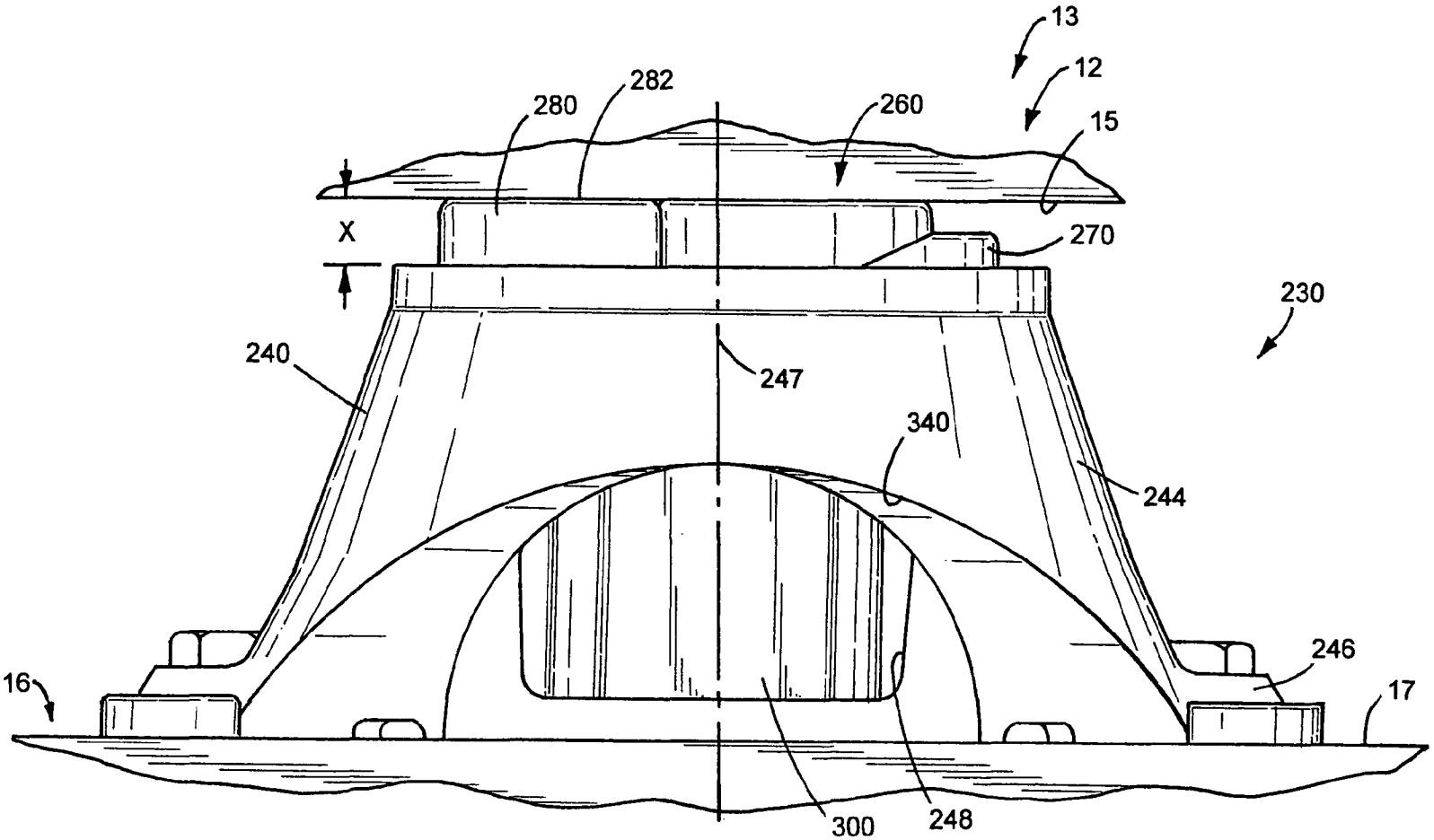
FIG. 5 is an enlarged side view of an alternative embodiment of a constant contact side bearing assembly embodying principals and teachings of this invention disclosure.
Figure 6:
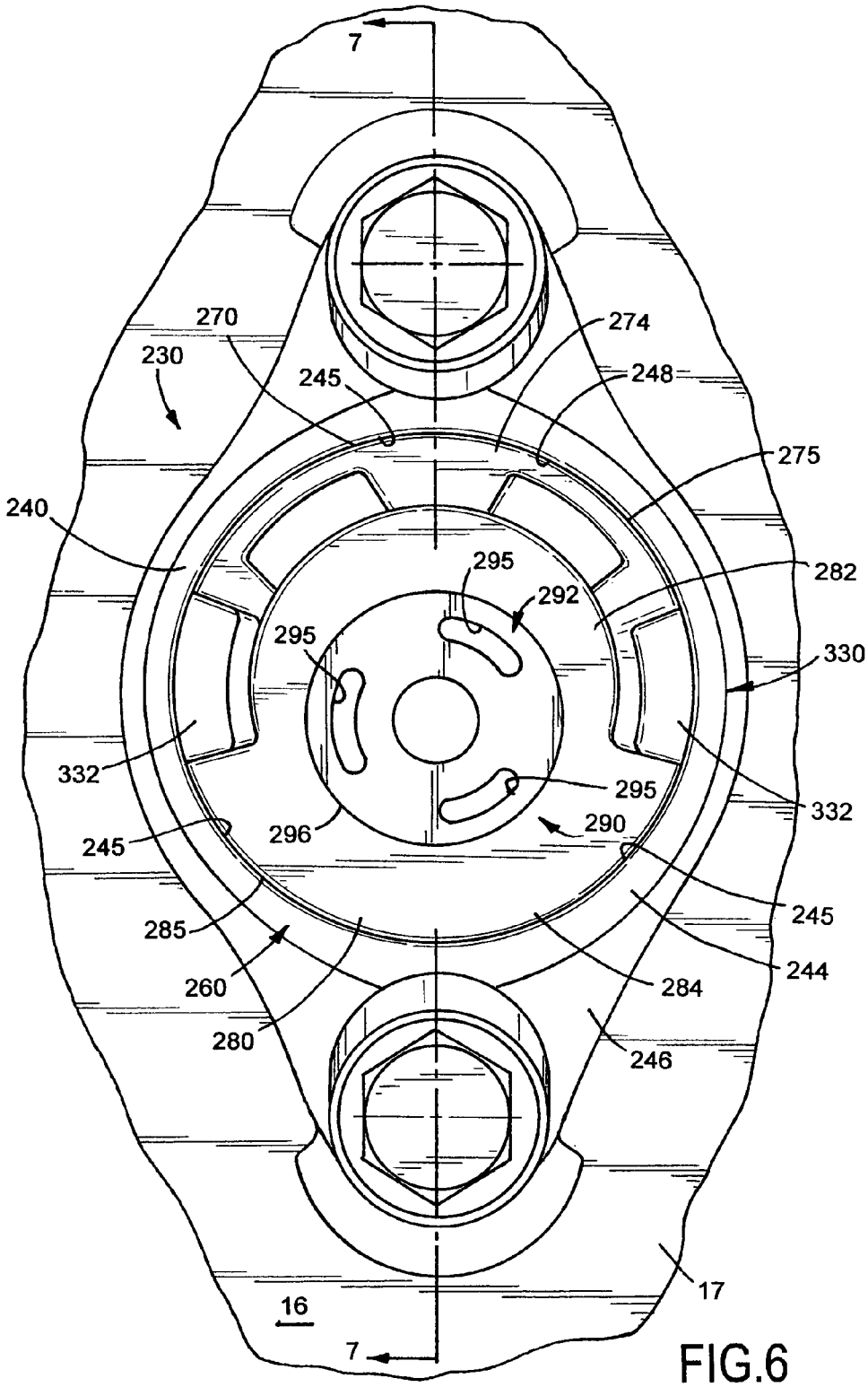
FIG. 6 is a top plan view of the constant contact side bearing assembly illustrated in FIG. 5.
Figure 7:
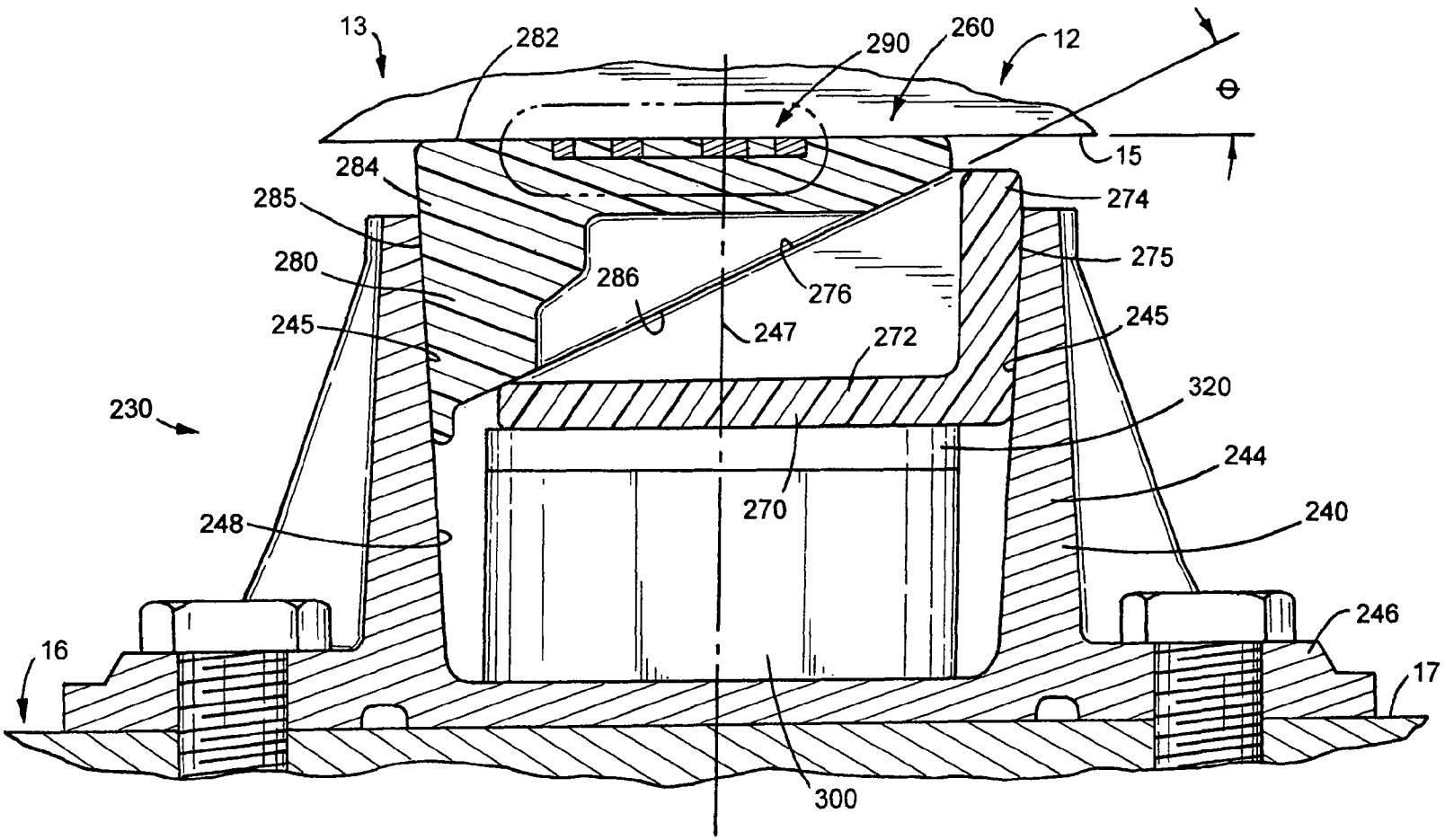
FIG. 7 is a sectional view taken along line 7-7 of FIG. 6.

FIGS. 5, 6 and 7 illustrate an alternative form for the constant contact side bearing assembly of the present invention. This alternative form of the constant contact side bearing assembly is designated generally by reference numeral 230. The elements of this alternative form of side bearing assembly that are functionally analogous to those components discussed above regarding side bearing assembly 30 are designated by reference numerals identical to those listed above with the exception this embodiment uses reference numerals in the 200 series.

Side bearing assembly 230 includes a housing or cage 240, a multipiece cap 260 arranged for generally telescoping or vertical reciprocatory movements relative to the housing 240, and a spring 300 (FIG. 7). Housing 240 is preferably formed of a strong and wear resistant metal material such as steel or the like and includes wall structure 244 extending upwardly from a base 246 to define an axis 247 for side bearing assembly 230. The wall structure 244 extends upwardly from base 246 for a predetermined distance. The wall structure 244 of the side bearing housing 40 defines an open-top cavity or internal void 248 having a predetermined inner surface configuration 245. The housing base 246 is configured for suitable attachment to an upper surface 17 of the railcar bolster 16 in the same manner discussed above regarding housing base 46. In the illustrated embodiment, the side bearing housing 240 defines openings 340 (with only one being shown) on opposed sides thereof and which are arranged toward a lower end of the housing 244 toward an intersection of the wall structure 244 and base 246 for promoting the dissipation of heat from the cavity 248 during operation of the side bearing assembly 230.

The cap 60 for the side bearing assembly 230 includes a first member or spring seat 270 and a second member or top cap 280 arranged in operable combination relative to each other. In this embodiment, however, and to enhance the vertical reciprocity of the multipiece cap 260 relative to the housing 240, the first cap member or spring seat 270 and the second member or top cap 280 are each formed from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto. Besides being less weight than steel, forming the first member or spring seat 270 and the second member or top cap 280 from such non-metal, high performance plastic material has also shown lower wear rates than steel which, in turn, increases the expectant life of the side bearing assembly 230.

As shown in FIG. 7, the spring seat 270 is positioned within the housing 240 for generally vertical movements and includes a generally horizontal bed or supporting plate 272 and generally vertical wall structure 274. When arranged within the side bearing housing 240, the wall structure 274 of member 270 is arranged to one side of the vertical axis 247 of the side bearing assembly 230. Preferably, wall structure 274 is formed integral with the supporting plate 272. Notably, and as shown in FIGS. 6 and 7, an outer surface 275 on the wall structure 274 of the spring seat 270 complements an inner surface 245 of the side bearing housing wall structure 244 arranged to one side of the vertical axis 247 of the side bearing assembly 230. In the embodiment illustrated for exemplary purposes, the side bearing housing inner surface 245 and the spring seat outer wall surface 275 each have a curved-surface configuration which complement each other and promote sliding movement therebetween.

As shown in FIG. 7, the second member 280 is at least partially positioned within the housing 240 for generally vertical movements and is operably carried by the first member 270. Member 280 desirably includes an upper generally flat surface 282. When the side bearing assembly 30 is secured to the bolster 16, the generally planar surface 282 of member 280 is disposed above a terminal end of the upstanding wall structure 244 of the side bearing housing for a predetermined distance. In the example shown, the normal distance between surface 282 of member 280 and the top edge of the wall structure 244, indicated by the distance "X" in FIG. 5, is determinative of the permissible compressive movement of the side bearing assembly 230 and such that after the underside 15 of the railcar body 12 contacts the upper edge of the housing structure 244, the side bearing assembly 230 functions as a solid unit and will prevent further rocking and relative movement between the bolster 16 and the railcar body 12.

As shown in FIG. 7, cap member 280 furthermore includes generally vertical wall structure 284 which, when cap member 280 is assembled in operable relation with the side bearing assembly, is disposed to an opposite side of the axis 247 from the upstanding wall structure 274 of cap member 270. Preferably, the wall structure 284 is formed integral with the generally planar surface 282 of cap 280. As shown in FIGS. 6 and 7, an outer surface 285 on the wall structure 284 of cap 280 complements the side bearing housing wall structure inner surface 245 disposed to an opposed side of the vertical axis 247 of the side bearing assembly 230 from surface 275 of member 270. In the embodiment illustrated for exemplary purposes, the side bearing housing inner surface 245 and the wall structure outer surface 285 on member 80 each have a curved surface configuration which complement each other and promote sliding movement therebetween.

One of the salient aspects of this invention disclosure relates to the ability to limit—if not eliminate—horizontal shifting movements of the side bearing assembly cap 60 relative to the side bearing assembly housing 40 whereby significantly enhancing operating performance characteristics of the side bearing assembly 230. To accomplish this desired end, and as illustrated in FIG. 7, the first and second cap members 270 and 280 define non-vertical interengaging and slidable surfaces 276 and 286, respectively, therebetween for maintaining the outer surfaces 275 and 285 of the respective members 270 and 280 in frictional sliding contact with the inner surface 245 of the side bearing housing 40. That is, and in response to a vertical load being directed against the side bearing assembly 230, the cooperating angled surfaces 276 and 286 defined by the respective first and second members 270 and 280 of the multipiece cap 260 urge the spring seat 270 and top cap 280 in opposite directions relative to each other and away from the centerline or upstanding axis 247 of the side bearing assembly 30 such that the outer surfaces 275 and 285 on each of the first and second member 270 and 280, respectively, are constantly urged toward and maintained in sliding engagement with the inner surface 245 of the side bearing housing 240.

In one form, the non-vertical surfaces 276 and 286 of the first and second members 270 and 280, respectively, of the multipiece side bearing assembly cap 260 are disposed at a predetermined angle θ. In one form, the predetermined angle θ ranges between about 20° and about 30° relative to a horizontal plane. In a most preferred form, the cooperating angled surfaces 276 and 286 between the first and second members 270 and 280, respectively, of cap 260 are disposed at an angle of about 25° relative to a horizontal plane.

Like side bearing assembly 30 discussed above, in the embodiment of the side bearing assembly 230 illustrated in FIG. 7, spring 300 is arranged in operable combination with housing 240 and cap members 270, 280 for absorbing, dissipating and returning energy imparted to the multipiece cap 260. The spring 300 is preferably of the type described above regarding spring 100 and incorporated herein by reference. As shown, spring 300 is arranged and accommodated within the cavity 248 defined by housing 240. Moreover, the spring 300 can include a thermal insulator 320 of the type disclosed above and incorporated herein by reference. Like the configuration of the side bearing assembly, the exact shape or form of the spring 300 can vary or be different from that illustrated for exemplary purposes without detracting or departing from either the spirit or scope of this invention disclosure.

In the embodiment shown in FIGS. 5 and 7, the top cap 280 furthermore includes an insert 290 that is maintained in operable association with and preferably generally centered on the upper generally flat surface 282 on member 280. The insert 290 is preferably formed from a metal material selected from the class of: steel and austempered ductile iron. As shown in FIG. 7, the insert 290 is arranged in operable association with the top cap 280 so as to slidably interact and contact with the an underside 15 of the car body 12. In the embodiment illustrated by way of example, the insert 280 has a diameter of about 3 inches. Suffice it to say, the insert 290 is engineered and designed whereby allowing the side bearing assembly 230 to establish a coefficient of friction ranging between about 0.4 and about 0.9 with the railcar 13 during operation of the constant contact side bearing assembly 230 so as to limit hunting movements and oscillation of the wheeled truck assembly 10 as the railcar moves over the tracks.

Figure 8:
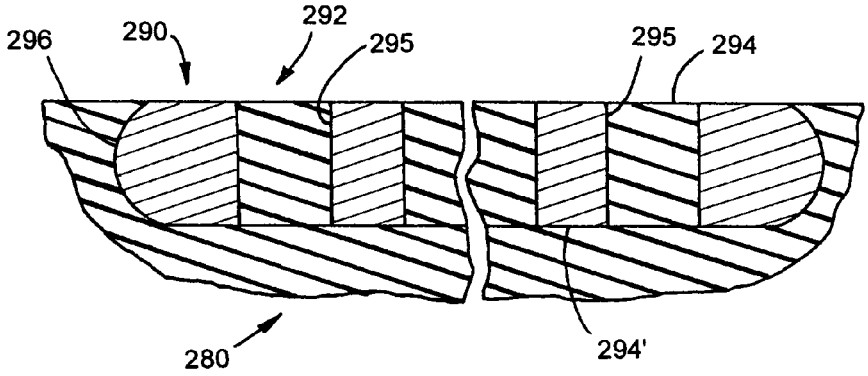
FIG. 8 is an enlarged view of that area encircled in phantom lines in FIG. 7.

In the embodiment shown in FIGS. 6 and 8, the top cap 280 and insert 290 define cooperating instrumentalities 292 for maintaining the top cap 280 and insert 290 in operable association relative to each other. As will be appreciated, the exact shape and design of the cooperating instrumentalities 292 for maintaining the top cap 280 and insert 290 in operable association relative to each other can take a myriad of designs and configuration without detracting or departing from the spirit and scope of this invention disclosure.

In the embodiment illustrated in FIG. 6, the insert 290 has a disc-like or generally circular configuration. Moreover, and as shown by way of example in FIG. 8, the insert 280 is provided with generally planar and generally parallel surfaces 294 and 294' which, in one form, are separated by a distance of about 0.375 inches. In this embodiment, the cooperating instrumentalities 292 preferably includes a series of arcuate equally spaced grooves or channels 295 which, preferably, are concentrically arranged relative to each other and relative to a periphery 296 of insert 290. Each groove or channel 295 preferably opens to both surfaces 294 and 294' on the insert 290. As such, and when the non-metal top cap 280 is formed, plastic material comprising the top cap 280 can flow into each groove or channel 295 whereby maintaining the top cap 280 and insert 290 in operable association relative to each other.

In the embodiment shown by way of example in FIG. 8, the periphery 296 of the insert 290 is preferably provided with a barrel-like shape or configuration such that a mid-region of the periphery 296 thereof extends radially outward a further extent from a center of the insert 290 than does a peripheral edge of the insert 290 at the intersection of the peripheral edge 296 with either flat surface 294 or 294' of insert 290. As such, and when the non-metal top cap 280 is being formed, plastic material comprising the top cap 280 encapsulates the periphery 296 of the insert 290 in a manner promoting and maintaining the top cap 280 and insert 290 in operable association relative to each other.

Returning to FIG. 6, the side bearing housing 240 along with at least one of the first and second members 270 and 280 of the multipiece cap 260 preferably define cooperating instrumentalities 330 for guiding the members the cap members 270, 280 for vertical reciprocatory movements relative to the housing 240 and for maintaining a predetermined relation between the cap 260 and the side bearing housing 240. As shown in FIG. 6, the interior surface 245 of the side bearing housing 240 preferably defines a pair of vertically extending splines or keys 332 which, in the illustrated embodiment, are positioned in diametrically opposed relation from each other. Each spline or key 332 extends along the interior surface 245 of the side bearing housing 240 for a vertical distance which is sufficient to accommodate and guide vertical reciprocatory movements of at least one member 270, 280 of the side bearing cap 260 during operation of the side bearing assembly 30. With the exception of being offset about 90 degrees relative to the cooperating instrumentalities 130 discussed above, it should be understood the cooperating instrumentalities 330 are substantially similar in design to the cooperating instrumentalities 130 discussed above and incorporated herein by reference.

Figure 9:
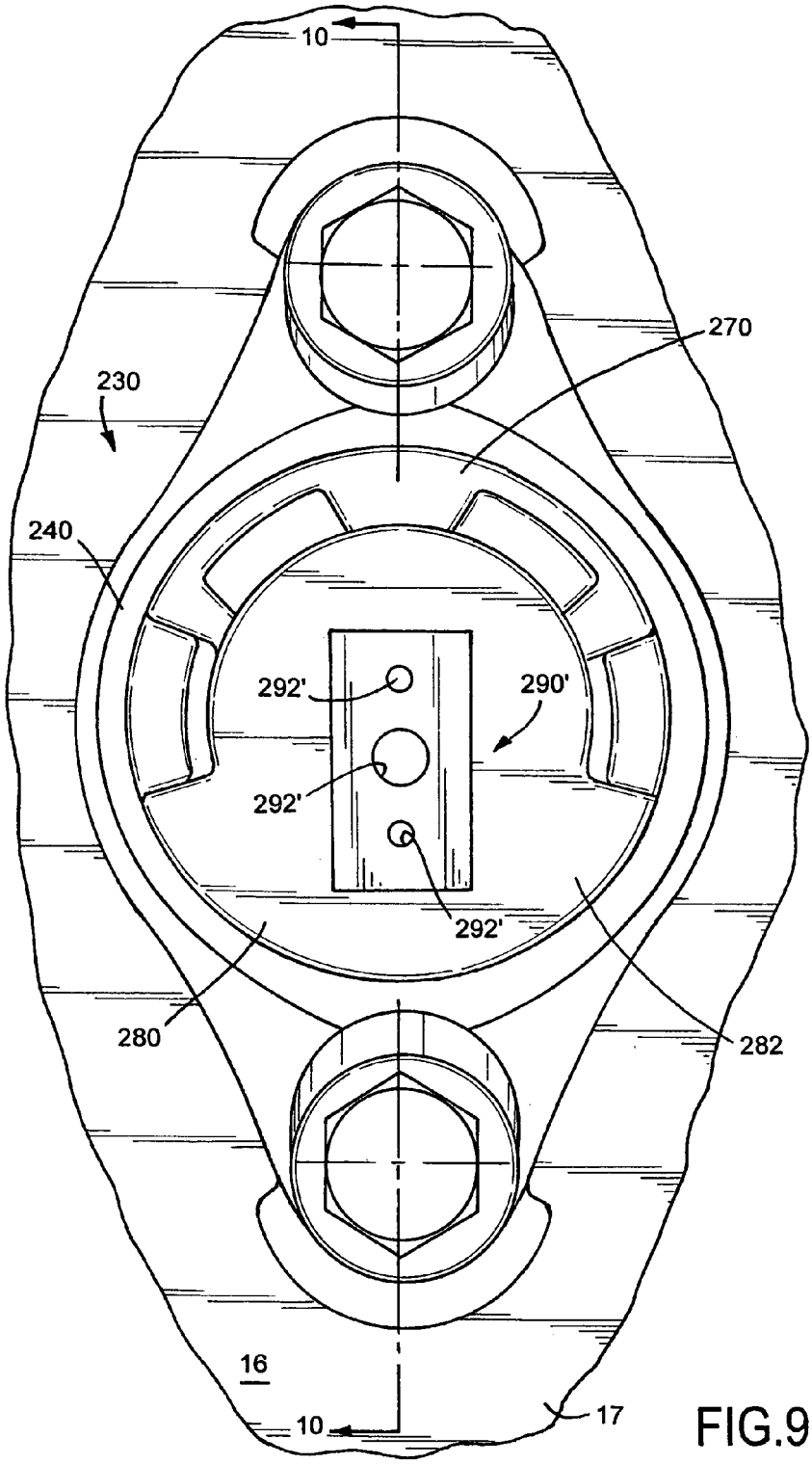
FIG. 9 is an enlarged top plan view of an alternative embodiment of a constant contact side bearing assembly embodying principals and teachings of this invention disclosure.
Figure 10:
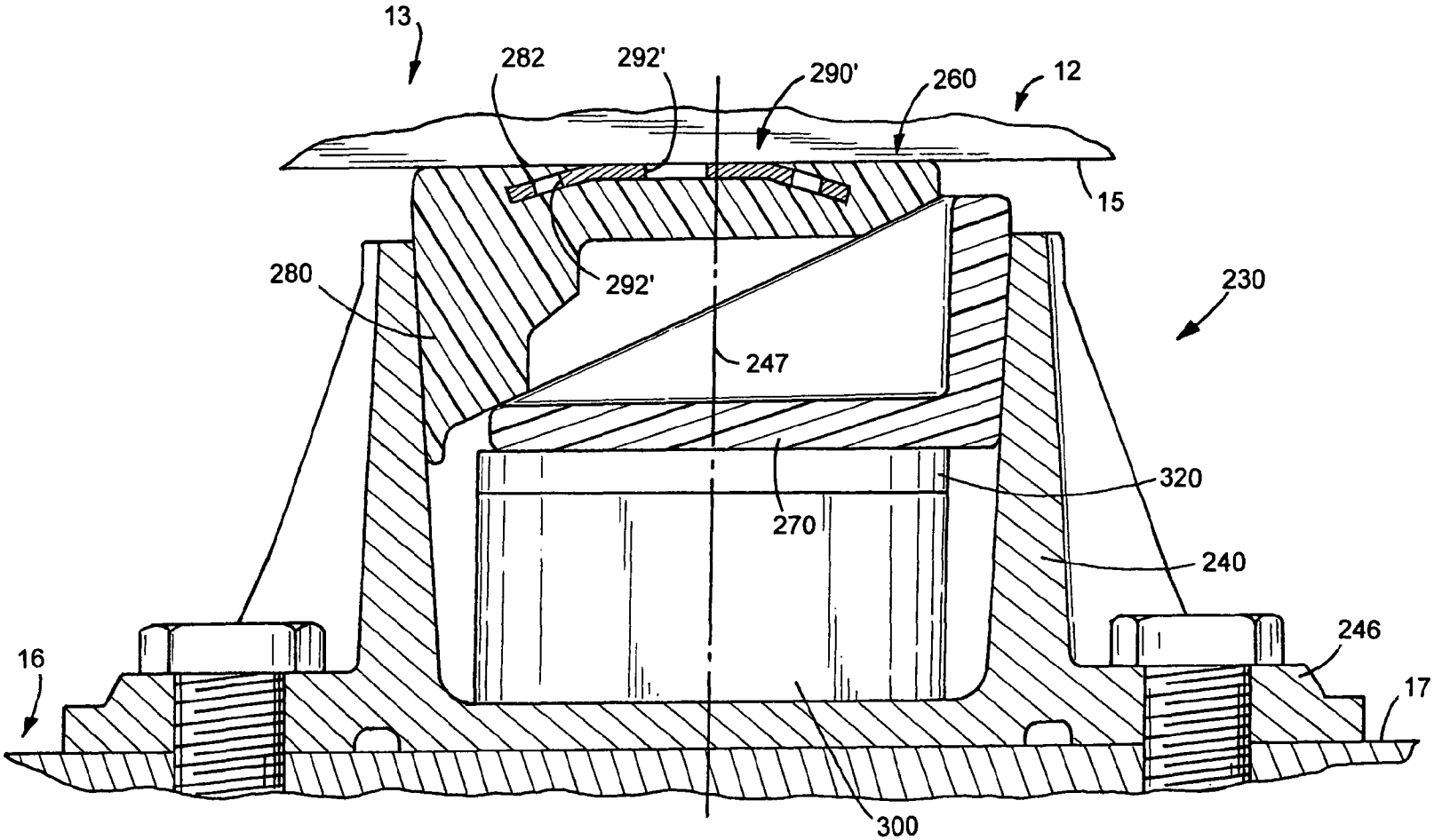
FIG. 10 is a sectional view taken along line 10-10 of FIG. 9.

FIGS. 9 and 10 illustrate an alternative form for the insert for the top cap 280. This alternative form of insert is designated generally by reference numeral 290'. With the exception of insert 290', the other features of the top cap or second member 280 are substantially identical to that discussed above.

Insert 290' is maintained in operable association with and preferably generally centered on the upper generally flat surface 282 on member 280. Insert 290' is preferably formed from a metal material selected from the class of: steel and austempered ductile iron. In the illustrated embodiment, insert 290' has a generally rectangular configuration with the elongated configuration of the insert 290' extending generally parallel with the elongated axis 18 of the car body 12 (FIGS. 1 and 4). The insert 290' shown by way of example in FIGS. 9 and 10 has a lateral width of about 2.0 inches, a length of about 3.5 inches, and a thickness of about 0.375 inches. The insert 290' is arranged in operable association with the top cap 280 so as to slidably interact and contact with the underside 15 of the car body 12. (FIG. 10) Suffice it to say, like insert 290, insert 290' is engineered and designed whereby allowing the side bearing assembly 230 to establish a coefficient of friction ranging between about 0.4 and about 0.9 with the railcar during operation of the constant contact side bearing assembly 230 so as to limit hunting movements and oscillation of the wheeled truck assembly 10 as the railcar moves over the tracks.

In the embodiment illustrated by way of example in FIG. 10, and during formation of the top cap 280, opposed longitudinal ends of the insert 290' are preferably embedded or otherwise secured beneath the generally flat or planar surface 282 of the top cap 280. Like insert 290, the insert 290 can be furthermore provided with suitable slots, grooves or other forms of cooperating instrumentalities 292' for maintaining the top cap 280 and insert 290' in operable association relative to each other. As mentioned, the exact shape and design of the cooperating instrumentalities 292' for maintaining the top cap 280 and insert 290' in operable association relative to each other can take a myriad of designs and configuration without detracting or departing from the spirit and scope of this invention disclosure.

Figure 11:
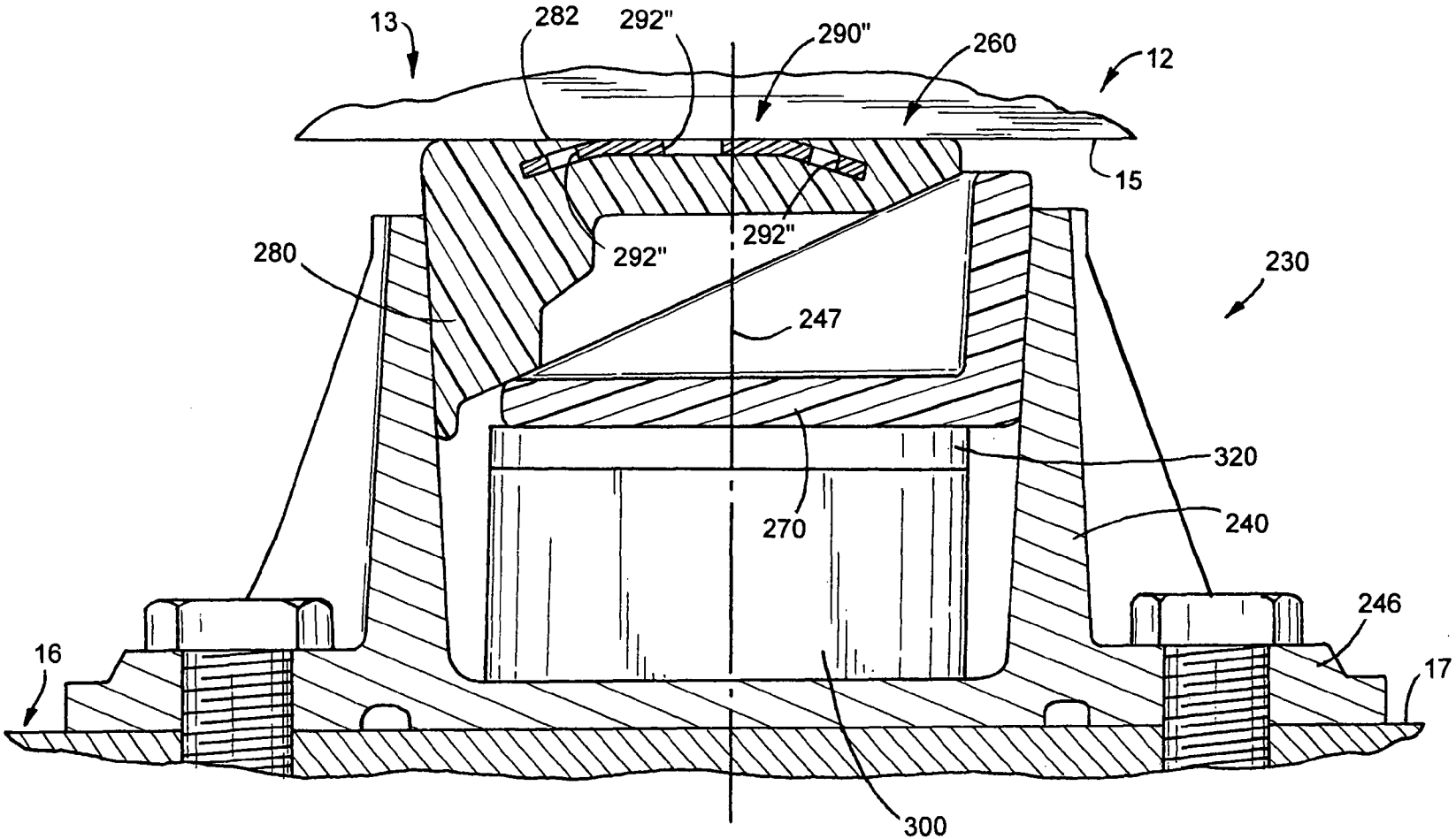
FIG. 11 is a sectional view similar to FIG. 10 showing an alternative form of insert.

FIG. 11 illustrates another alternative form for the insert for the top cap 280. This alternative form of insert is designated generally in FIG. 11 by reference numeral 290". With the exception of insert 290", the other features of the top cap or second member 280 are substantially identical to that discussed above.

Insert 290" is maintained in operable association with and preferably generally centered on the upper generally flat surface 282 on member 280. Insert 290" is preferably formed from a composite material similar to that used in automobile and/or railcar brake shoes and the like. In the illustrated embodiment, insert 290" has a generally rectangular configuration with the elongated configuration of the insert 290" extending generally parallel with the elongated axis 18 of the car body 12 (FIGS. 1 and 4). Suffice it to say, the insert 290" is arranged in operable association with the top cap 280 so as to slidably interact and contact with the underside 15 of the car body 12. Like insert 290, insert 290" is engineered and designed whereby allowing the side bearing assembly 230 to establish a coefficient of friction ranging between about 0.4 and about 0.8 with the railcar during operation of the constant contact side bearing assembly 230 so as to limit hunting movements.

In the embodiment illustrated by way of example in FIG. 11, and during formation of the top cap 280, opposed longitudinal ends of the insert 290" are preferably embedded or otherwise secured beneath the generally flat or planar surface 282 of the top cap 280. Like insert 290, the insert 290" can be furthermore provided with suitable slots, grooves or other forms of cooperating instrumentalities 292" for maintaining the top cap 280 and insert 290" in operable association relative to each other. As mentioned, the exact shape and design of the cooperating instrumentalities 292' for maintaining the top cap 280 and insert 290" in operable association relative to each other can take a myriad of designs and configuration without detracting or departing from the spirit and scope of this invention disclosure.

Figure 12:
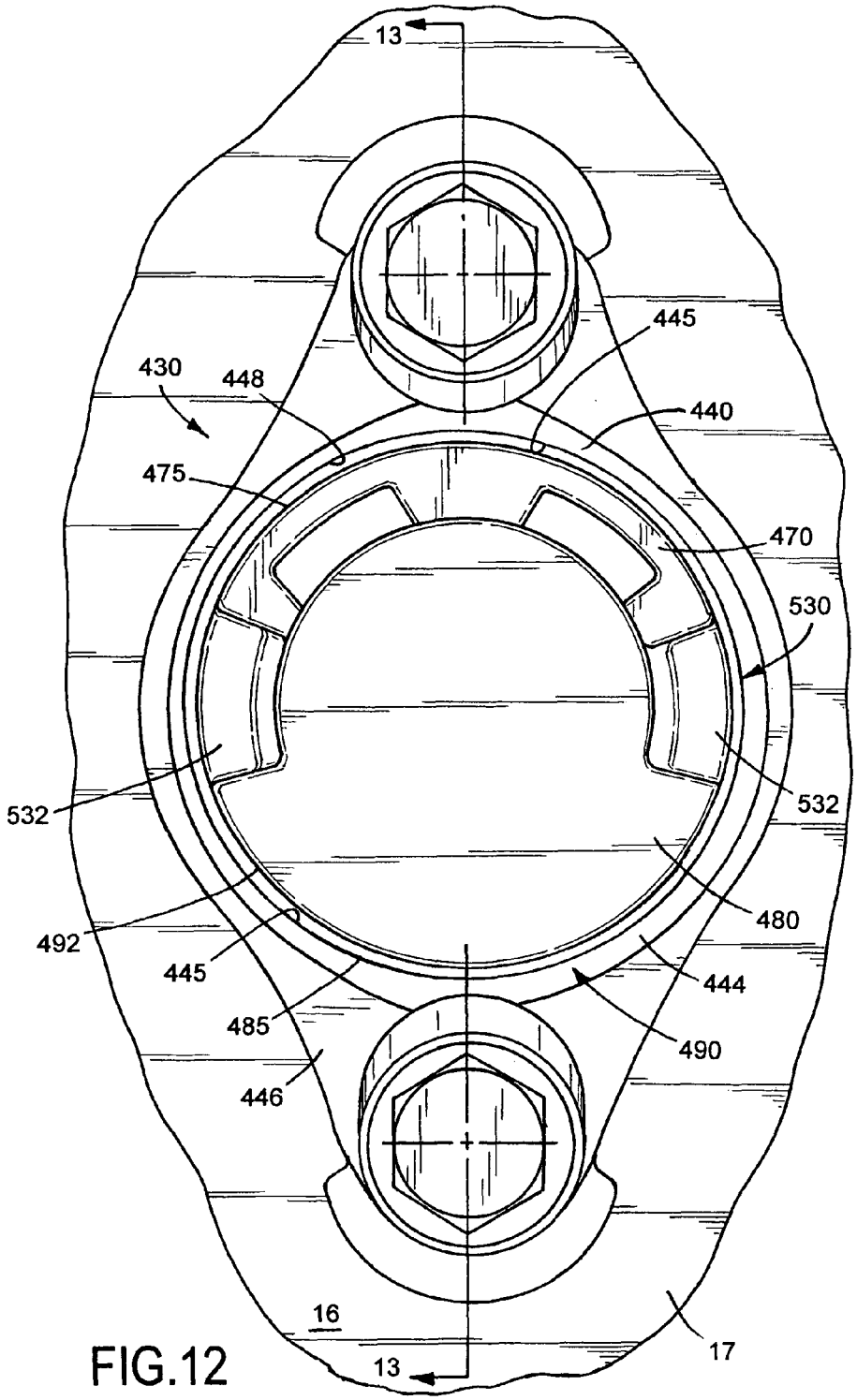
FIG. 12 is an enlarged top plan view of another alternative embodiment of a constant contact side bearing assembly embodying principals and teachings of this invention disclosure.
Figure 13:
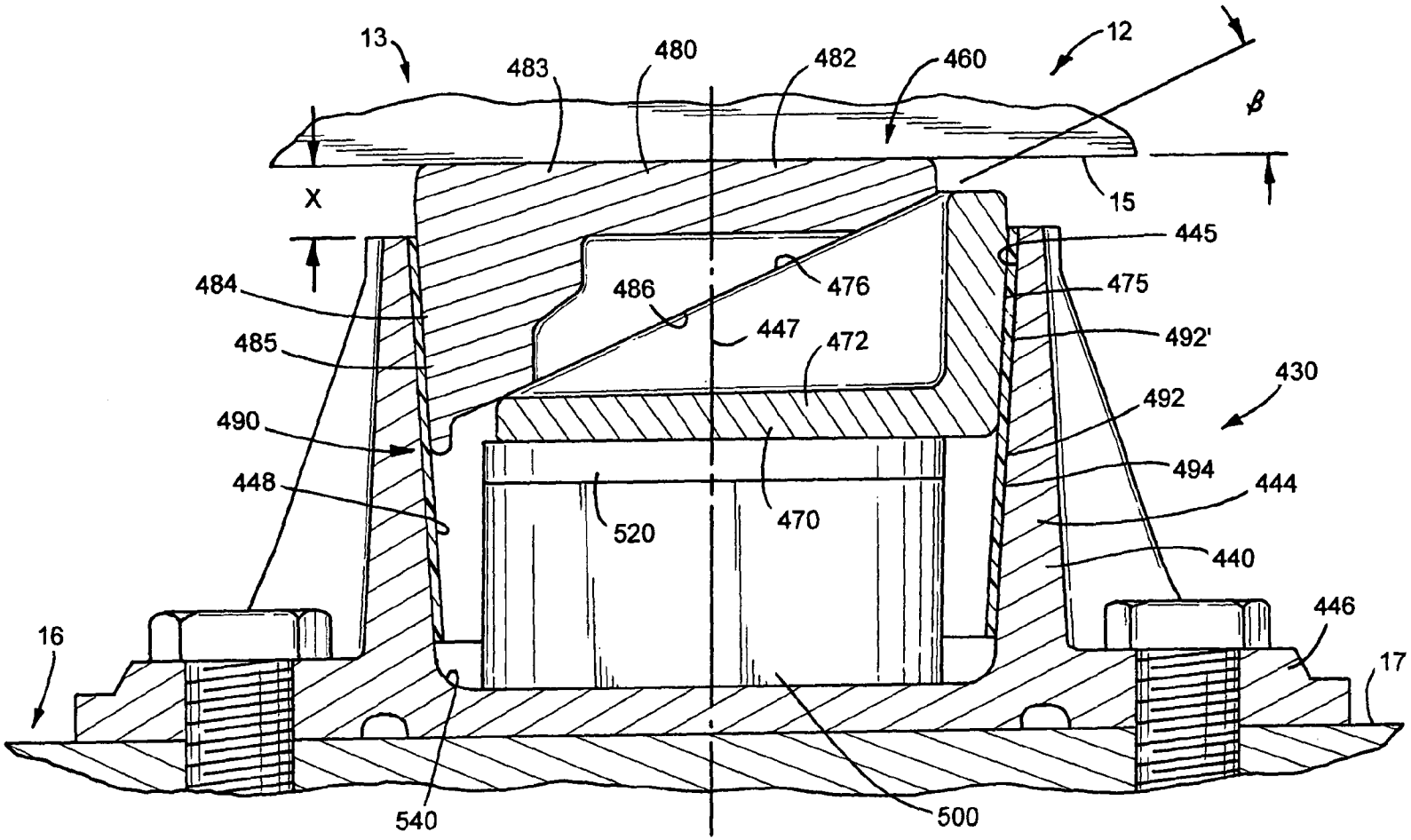
FIG. 13 is a sectional view taken along line 13-13 of FIG. 12.

FIGS. 12 and 13 illustrate still another family of embodiments for the constant contact side bearing assembly of the present invention disclosure. This alternative form of the constant contact side bearing assembly is designated generally by reference numeral 430. The elements of this alternative form of side bearing assembly that are functionally analogous to those components discussed above regarding side bearing assembly 30 are designated by reference numerals identical to those listed above with the exception this embodiment uses reference numerals in the 400 series.

Side bearing assembly 430 includes a housing or Cage 440, a multipiece cap 460 arranged for generally telescoping or vertical reciprocatory movements relative to the housing 440, and a spring 500 (FIG. 13). Housing 440 is preferably formed of a strong and wear resistant metal material such as steel or the like and includes wall structure 444 extending upwardly from a base 446 to define an axis 447 for side bearing assembly 430. The wall structure 444 extends upwardly from base 446 for a predetermined distance. The wall structure 444 of the side bearing housing 440 defines an open-top cavity or internal void 448 having a predetermined inner surface configuration 445. The housing base 446 is configured for suitable attachment to an upper surface 17 of the railcar bolster 16 in the same manner discussed above regarding housing base 46. In this alternative embodiment, the housing 440 defines openings 540 (with only one being shown) on opposed sides thereof and which are arranged toward a lower end of the housing 440 adjacent an intersection of the wall structure 444 and base 446 for promoting the dissipation of heat from the cavity 448 during operation of the side bearing assembly 430.

The multipiece cap 460 for the side bearing assembly 330 includes a first member or spring seat 470 and a second member or top cap 480 arranged in operable combination relative to each other. Both members 470 and 480 are preferably made from a strong and wear resistant metal material such as steel or the like. As shown in FIG. 13, the spring seat 470 is positioned within the housing 440 for generally vertical movements and includes a generally horizontal bed or supporting plate 472 and generally vertical wall structure 474. When arranged within the side bearing housing 440, the wall structure 474 of member 470 is arranged to one side of the vertical axis 447 of the side bearing assembly 430. Preferably, wall structure 474 is formed integral with the supporting plate 472. Notably, and as shown in FIGS. 12 and 13, an outer surface 475 on the wall structure 474 on spring seat 470 complements the inner surface 445 of the side bearing housing wall structure 444 arranged to one side of the vertical axis 447 of the side bearing assembly 30. In the embodiment illustrated for exemplary purposes, the side bearing housing inner surface 445 and the spring seat outer wall surface 475 each have a curved surface configuration which complement each other and promote sliding movement therebetween.

As shown in FIG. 13, the second member 480 is at least partially positioned within the housing 440 for generally vertical movements and is operably carried by the first member 470. Member 480 desirably includes a generally horizontal plate 482 defining an upper generally planar surface 483 which is adapted to frictionally engage and slide relative to an underside 15 of the car body 12. When the side bearing assembly 430 is secured to the bolster 16, at least a portion of the planar surface 483 of member 480 is disposed above a terminal end of the upstanding wall structure 444 of the side bearing housing for a predetermined distance. In the example shown, the normal distance between surface 483 of member 480 and the top edge of the wall structure 444, indicated by the distance "X" in FIG. 13, is determinative of the permissible compressive movement of the side bearing assembly 430 and such that after the underside 15 of the railcar body 12 contacts the upper edge of the housing structure 444, the side bearing assembly 430 functions as a solid unit and will prevent further rocking and relative movement between the bolster 16 and the railcar body 12.

As shown, cap member 480 furthermore includes generally vertical wall structure 484 which, when member 480 is assembled in operable relation with the side bearing assembly is disposed to an opposite side of the axis 447 from wall structure 474 of cap member 470. Preferably, wall structure 484 is formed integral with plate 482. As shown in FIGS. 12 and 13, an outer surface 485 on the wall structure 484 of cap member 480 complements the inner surface 245 of the side bearing housing wall structure 244 disposed to an opposed side of the vertical axis 447 of the side bearing assembly 430 from surface 475 of member 470. In the embodiment illustrated for exemplary purposes, the side bearing housing inner surface 445 and the outer surface 485 on the wall structure 484 of cap member 480 each have a curved surface configuration which complement each other and promote sliding movement therebetween.

As mentioned, one of the salient aspects of this invention disclosure relates to the ability to limit—if not eliminate—horizontal shifting movements of the side bearing assembly cap relative to the side bearing assembly housing whereby significantly enhancing operating performance characteristics of the side bearing assembly. To accomplish this desired end, and in the embodiment illustrated in FIG. 13, the first and second members 470 and 480 of the multipiece cap 460 define non-vertical interengaging and slidable surfaces 476 and 486, respectively, therebetween for urging the outer surfaces 475 and 485 of cap members 470 and 480, respectively, in opposed directions relative to each other and toward the inner surface 445 of the side bearing housing 440. That is, and in response to a vertical load being directed against the side bearing assembly 430, the cooperating angled surfaces 476 and 486 defined by the respective first and second members 470 and 480 of the multipiece cap 460 urge the spring seat 470 and member 460 in opposite directions relative to each other and away from the centerline or upstanding axis 447 of the side bearing assembly 430 such that the outer surfaces 475 and 485 on each of the first and second member 470 and 480, respectively, are constantly urged toward and maintained in sliding engagement with the inner surface 445 of the side bearing housing 440.

In the form shown by way of example in FIG. 13, the non-vertical surfaces 476 and 486 of the first and second members 470 and 480 of the multipiece side bearing assembly cap 460 are disposed at a predetermined angle β. The predetermined angle β ranges between about 17° and about 40° relative to a horizontal plane. In a most preferred form, the cooperating angled surfaces 476 and 486 between the first and second members 470 and 480, respectively, of cap 460 are disposed at an angle of about 25° relative to a horizontal plane.

To increase the angular range between the inclined surfaces 476 and 486 of the respective pieces 470 and 480 of the top cap 460 while maintaining their sliding contact with and vertical reciprocity relative to the side bearing housing 440, this embodiment of the invention disclosure includes structure 490 provided between the first or inner sliding surface 445 on the wall structure 444 housing 440 and each of the outer sliding surfaces 475 and 485 of the cap members or pieces 470 and 480, respectively. As will be understood, structure 490 inhibits binding and promotes vertical reciprocatory movements of the spring seat 470 and top cap 480 relative to the housing 440 during operation of the side bearing assembly.

Structure 490 can take a myriad of designs without detracting or departing from the true spirit and scope of this invention disclosure. In the embodiment shown in FIGS. 12 and 13, structure 490 includes at least one non-metal insert 492 extending axially along and carried by at least one of the sliding surface 445 on the wall structure 444 of the housing 440 and each of the sliding surfaces 475 and 485 on the spring seat 470 and top cap 480, respectively. In the illustrated embodiment, the insert 492 is in the form of a sleeve 494 axially extending between the sliding surface 445 on the wall structure 444 of the housing 440 and each of the second and third sliding surfaces 475 and 485 on the spring seat 470 and top cap 480, respectively. Suffice it to say, the individual inserts 492 or sleeve 494 extend, for an axial distance at least equivalent to the axial distance the second and third sliding surfaces 475 and 485 on the spring seat 470 and top cap 480, respectively, axially move relative to the side bearing housing 440.

In one preferred form, the insert 492 has a relatively thin or narrowed thickness. In one form, insert 492 is preferably made from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto.

Figure 14:
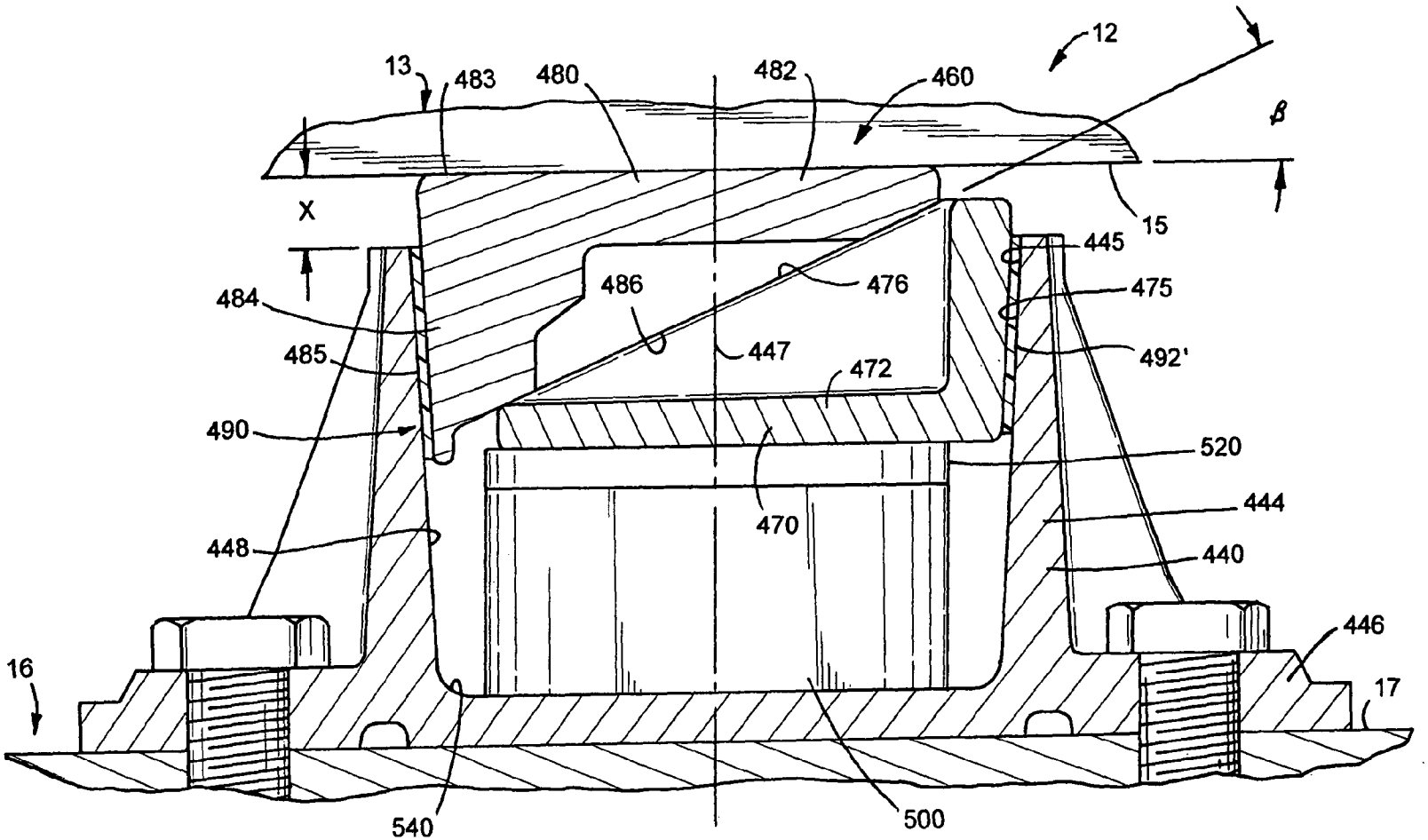
FIG. 14 is a sectional view similar to FIG. 13 showing an alternative form of insert.

In the embodiment illustrated in FIG. 14, structure 490 includes a coating 492' provided axially along and carried by at least one of the sliding surface 445 on the wall structure 444 of the housing 440 and each of the second and third sliding surfaces 475 and 485 on the spring seat 470 and top cap 480, respectively. In the illustrated embodiment, the coating 492' axially extends between the sliding surface 445 on the wall structure 444 of the housing 440 and each of the second and third sliding surfaces 475 and 485 on the spring seat 470 and top cap 480, respectively, for a distance at least equivalent to the axial distance the second and third sliding surfaces 475 and 485 on the spring seat 470 and top cap 480, respectively, axially move relative to the side bearing housing 440.

In one preferred form, the coating 492' has a relatively thin or narrowed thickness. In one form, the coating 492' preferably comprises a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto.

Like the side bearing assembly 30 discussed above, in the embodiment of the side bearing assembly 430 illustrated for exemplary purposes in FIGS. 13 and 14, a spring 500 is arranged in operable combination with and for absorbing, dissipating and returning energy imparted to the multipiece cap 460. The spring 500 is preferably of the type described above regarding spring 100 and incorporated herein by reference. As shown, spring 500 is arranged and accommodated within the cavity 448 defined by housing 440. Moreover, the spring 500 can include a thermal insulator 520 of the type disclosed above and incorporated herein by reference. Like the configuration of the side bearing assembly, the exact shape of form of the spring 500 can vary or be different from that illustrated for exemplary purposes without detracting or departing from either the spirit or scope of this invention disclosure.

Moreover, and in the embodiment illustrated in FIG. 12, the side bearing housing 440 along with at least one of the first and second members 470 and 480 of the multipiece cap 460 define cooperating instrumentalities 530 for guiding the cap members 470 and 480 for vertical reciprocatory movements relative to the housing 440 and for maintaining a predetermined relation between the cap 460 and the side bearing housing 440. As shown in FIG. 12, the interior surface 445 of the side bearing housing 440 preferably defines a pair of vertically extending splines or keys 532 which, in the illustrated embodiment, are positioned in diametrically opposed relation from each other. Each spline or key 532 extends along the interior surface 445 of the side bearing housing 440 for a vertical distance which is sufficient to accommodate and guide vertical reciprocatory movements of at least one member 470, 480 of the side bearing cap 460 during operation of the side bearing assembly 430. With the exception of being offset about 90 degrees relative to the cooperating instrumentalities 130 discussed above, it should be understood the cooperating instrumentalities 530 are substantially similar in design to the cooperating instrumentalities 130 discussed above and incorporated herein by reference.

Figure 15:
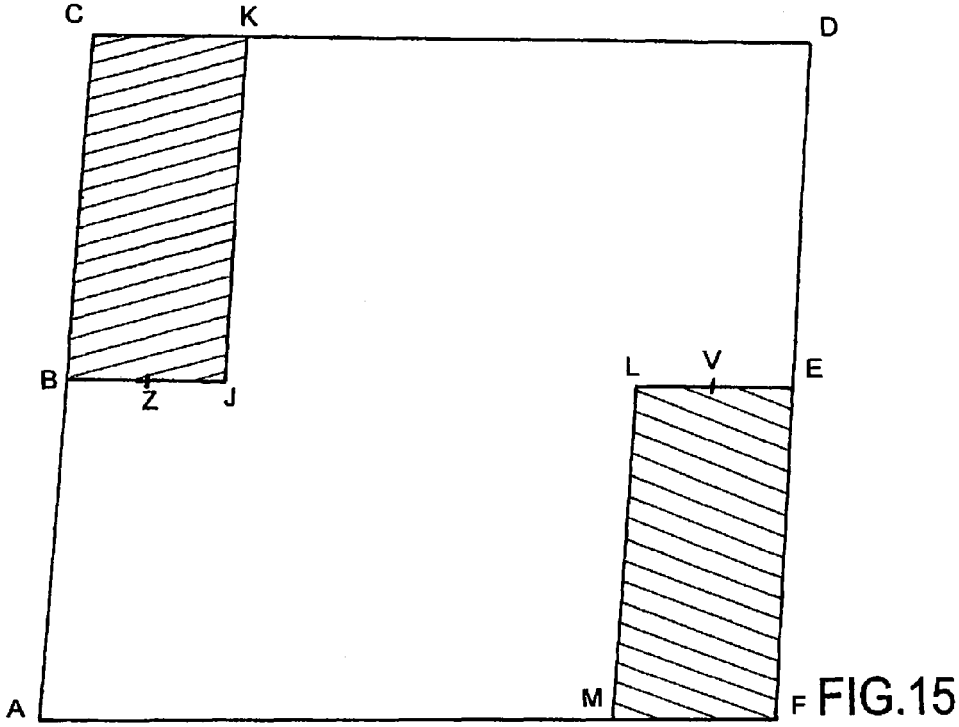
FIG. 15 is representative of a force-displacement plot of hysteresis loops of both a prior art type constant contact side bearing assembly and an embodiment of a constant contact side bearing assembly according to this invention disclosure.

The advantages provided by a side bearing assembly embodying principals of this invention disclosure are illustrated by way of example in FIG. 15 which schematically illustrates a calculated longitudinal force-displacement hysteresis loop of the present disclosure wherein the outer parallelogram defined by points ABCDEFA represents a cycle length of a side bearing assembly embodying principals of the present disclosure as the bolster 16 of truck assembly 10 oscillates or "hunts" between extreme positions of travel about the center bearing plate 22 (FIG. 1). It should be noted, however, the schematic illustration in FIG. 15 is intended for illustrative purposes only and should not be interpreted or construed, directly or indirectly, as representing actual measurements of loads applied to or movements associated with components parts of the side bearing assembly 30.

The area of the graph shown in FIG. 15 and defined by points ABZJKDEVLMA illustrates a calculated force-displacement hysteresis loop of a conventional side bearing assembly wherein a gap or space is required between the top cap and side bearing housing to allow for vertical displacement of the cap relative to the side bearing housing. More specifically, in the graph shown in FIG. 15, points ABZJKDEVLMA represent a cycle length of a conventional side bearing assembly having a gap or space between the side bearing housing and cap and the effects on longitudinal loading of the side bearing assembly caused by such space or gap between the side bearing housing and cap as the truck assembly bolster 16 oscillates or "hunts" between extreme positions of travel about the center bearing plate 22 (FIG. 1).

Point A on the graph illustrated in FIG. 15 schematically represents the increased longitudinal loading on the side bearing assembly when the truck assembly bolster 16 (FIG. 1) is urged toward an extreme rotational position and the sidewalls of a conventional side bearing assembly are pressed into contact relative to each other by the longitudinal loads placed on the side bearing assembly as a result of the truck assembly "hunting" or yawing between positions as the railcar moves between locations. The distance between points A and B in FIG. 15 schematically represents the reduced longitudinal loading on the side bearing assembly as the truck assembly bolster 16 traverses in a first rotational direction away from one extreme rotational position.

Point B on the graph illustrated in FIG. 15 schematically represents the longitudinal loading on the side bearing when the railcar bolster is arranged toward a position, proximate to its extreme rotational position, but wherein the sidewalls of the side bearing housing and cap of the side bearing assembly have deflected as a result of the reduced longitudinal loads being removed therefrom. Points B and Z on the graph in FIG. 15 schematically illustrate the relatively constant longitudinal loading on the side bearing assembly as the truck assembly bolster 16 moves away from a position, proximate to its extreme rotational position, wherein longitudinal loads are lessened on and deflection has occurred to the sidewalls of the side bearing housing and cap, to a neutral or centered position. The relatively constant longitudinal loading of the railcar side bearing assembly remains as the cap longitudinally shifts in the gap between it and the side bearing housing is represented by the distance between points B and Z.

As shown in FIG. 15, between points Z and J, the longitudinal loading on the side bearing assembly loading remains relatively constant as the gap between the cap and side bearing assembly continues to collapse as the truck assembly bolster 16 continues to rotate about the center bearing plate 22 (FIG. 1) from the neutral position toward an opposite extreme rotational position. Point J on the graph shown in FIG. 15 represents the longitudinal loading on the side bearing assembly when the sidewalls of the side bearing housing and cap of a conventional side bearing assembly again contact relative to each other. The distance between points J and K on the graph shown in FIG. 15 schematically represents the increase in longitudinal loading on the side bearing assembly as the sidewalls of the side bearing housing and cap of a conventional side bearing assembly deflect as the bolster 16 continues to rotate or move toward the extreme rotational position during hunting movements of the truck assembly 10.

With the sidewalls of the side bearing housing and cap of a conventional side bearing assembly in contact relative to each other (point K), the longitudinal loading on the side bearing assembly remains relatively constant as indicated on the graph illustrated in FIG. 15 between points K and D. Between points K and D on the graph illustrated in FIG. 15, the railcar underside 15 slides relative to the side bearing assembly as the bolster continues to traverse toward an extreme rotational position.

Point D on the graph illustrated in FIG. 15 schematically represents the increased longitudinal loading on the side bearing assembly when the truck assembly bolster 16 (FIG. 1) is urged toward an extreme rotational position (opposite from the position represented in the graph shown in FIG. 15 by point A) and the sidewalls of the side bearing assembly are pressed into contact relative to each other by the increased longitudinal loads placed on the side bearing assembly as a result of the truck assembly "hunting" or yawing between positions as the railcar moves between locations. Between points D and E on the graph illustrated in FIG. 15, the longitudinal loading on the side bearing assembly is again reduced as a result of the truck assembly bolster 16 traversing in a second rotational direction away from one extreme rotational position toward a position arranged proximate the extreme rotational position but wherein deflection of the sidewalls of the side bearing housing and cap have occurred as a result of the longitudinal loads being removed therefrom. Points E and V on the graph in FIG. 15 schematically illustrate the relatively constant longitudinal loading on the side bearing assembly as the truck assembly bolster 16 moves away from a position, proximate to its extreme rotational position, wherein longitudinal loads are removed from the sidewalls of the side bearing housing and cap to a neutral or centered position. The relatively constant longitudinal loading of the railcar side bearing assembly remains as the cap longitudinally shifts in the gap between it and the side bearing housing is represented by the distance between points E and V.

As shown in FIG. 15, and between points V and L, the longitudinal loading on the side bearing assembly remains relatively constant as the gap between the cap and side bearing housing continues to collapse as the truck assembly bolster 16 continues to rotate about the center bearing plate 22 (FIG. 1) from the neutral position toward an opposite extreme rotational position and through a position (point L) wherein the sidewalls of the side bearing housing and cap of a conventional again come in contact relative to each other. The distance between points L and M on the graph shown in FIG. 15 schematically represents the increase in longitudinal loading on side bearing assembly as the sidewalls of the side bearing housing and cap, of a conventional side bearing assembly deflect as the bolster 16 continues to rotate or move toward the extreme rotational position during hunting movements of the truck assembly 10.

With the sidewalls of the side bearing housing and cap of a conventional side bearing assembly being in contact relative to each other (point M), the longitudinal loading on the side bearing assembly remains relatively constant as indicated on the graph illustrated in FIG. 15 between points M and A. Between points M and A on the graph illustrated in FIG. 15, the railcar underside 15 slides relative to the side bearing assembly as the bolster continues to traverse toward an extreme rotational position.

The adverse affects of the spacing between the top cap and housing of a conventional side bearing assembly are illustrated in FIG. 15 by the distance between points B and J along with the distance between points E and L. That is, as the truck assembly bolster 16 rotates during "hunting" movements thereof, the rotational movement of the truck assembly bolster 16 places a force or longitudinal load on the side bearing assembly whereby causing the top cap of the side bearing assembly to longitudinally shift relative to the side bearing housing until the distance separating the wall structure of the top cap and the wall structure of the side bearing housing collapses. The collapse of the distance separating the wall of the top cap from the wall of the side bearing housing is schematically represented in FIG. 15 by the distance between points B and J along with E and L. It is important to note, the distance separating the wall of the top cap from the wall of the side bearing housing on a conventional side bearing assembly progressively worsens with wear. That is, the distance separating the wall of the top cap from the wall of the side bearing housing, schematically represented in FIG. 15 by the distance between points B and J along with E and L, continues to increase with wear. Increased wear between the cap and side bearing housing reduces the energy absorption capability of the side bearing assembly.

Notably, the side bearing assembly of the present disclosure is furthermore designed to be self-adjusting. That is, during operation of the side bearing assembly embodying features of the present disclosure, the interengaging and sliding surfaces on the side bearing housing and the multipiece top cap automatically adjust to wear therebetween and, thus, are maintained in constant contact relative to each other. Accordingly, and with the present disclosure, there is substantially no lost motion between the top cap and side bearing housing when the truck assembly 10 shifts from one rotational position to the other. Accordingly, and as schematically represented in FIG. 15 those shaded areas marked with diagonal lines in the graph shown FIG. 15 are advantageously available for energy absorption by the side bearing assembly 30 during operation of the constant contact side bearing assembly. As noted above, those shaded areas marked with diagonal lines in the graph shown FIG. 15 schematically illustrating the enhanced ability of the side bearing assembly of the present disclosure to absorb energy will only increase when considering wear between the cap and side bearing housing of a conventional side bearing assembly.

Figure 16:
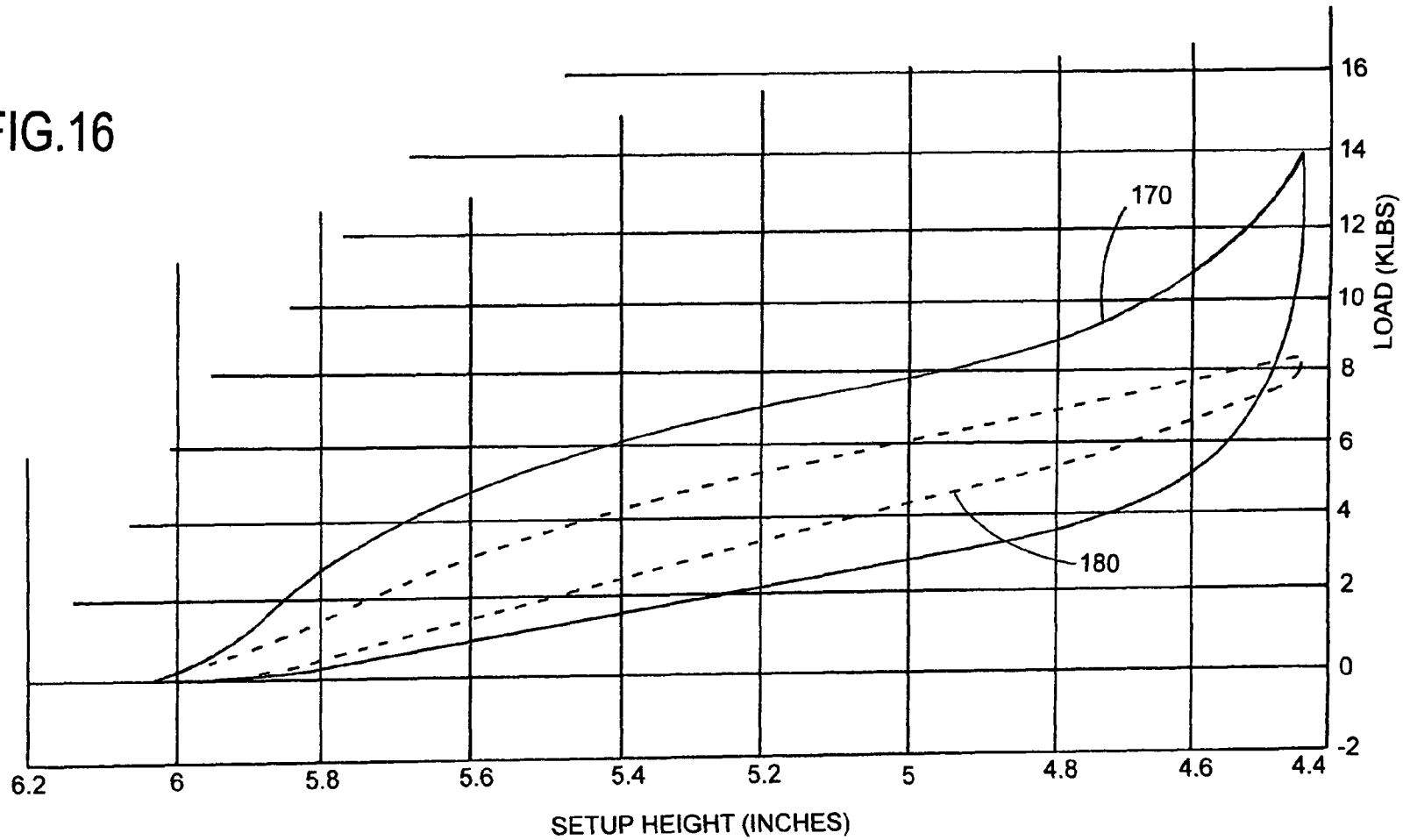
FIG. 16 is a graph showing the enhanced vertical energy capability offered by a side bearing assembly according to the invention disclosure and a prior art type constant contact side bearing assembly.

The advantages of a side bearing assembly embodying principals and teachings of the present disclosure are further exemplified in FIG. 16. The solid line or hysteresis loop 170 in the graph illustrated in FIG. 16 represents the vertical energy absorption capabilities of the side bearing assembly embodying principals and teachings of the present invention disclosure. The dash line or hysteresis loop 180 in the graph illustrated in FIG. 16 represents the vertical energy absorption capabilities of a conventional side bearing assembly. The enhanced ability of the side bearing assembly embodying principals of this invention disclosure to absorb, dissipate and return energy to the railcar as compared to a conventional side bearing design is readily apparent when the two hysteresis loops 170 and 180 are compared.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A constant contact side bearing assembly for a railcar, comprising:

a housing including upstanding wall structure defining a central axis for said side bearing assembly;

a multipiece cap arranged in operable combination with said housing and including a first non-metal member arranged for vertical reciprocatory movement within said housing, with said first non-metal member having wall structure arranged to slidably contact the wall structure of said housing during vertical reciprocatory movements of said first member, and with the wall structure of said first member being arranged to one side of the central axis of said side bearing assembly, a second non-metal member arranged within said housing and carried by said first member, with said second non-metal member including wall structure arranged to slidably contact said wall structure of said housing during vertical reciprocatory movements of said second member, and with the wall structure of said second member being arranged to a second side of the central axis of said side bearing assembly, and wherein a generally flat surface on said second non-metal member extends beyond the wall structure of said housing;

a spring arranged within said housing and generally centralized beneath both of said first and second members of said multipiece cap for returning energy imparted to said spring during operation of said side bearing assembly;

wherein said first and second members of said multipiece cap define non-vertical interengaging and slidable surfaces therebetween and disposed at an angle ranging between about 20 degrees and about 30 degrees relative to a horizontal plane for maintaining the wall structure on each of said non-metal members in sliding contact with the wall structure of said housing thereby limiting horizontal shifting movements of said multipiece cap relative to said housing; and wherein an insert is maintained in operable association with the generally flat surface on said second non-metal member to slidably contact with an underside of said railcar whereby allowing said side bearing assembly to establish a coefficient of friction ranging between about 0.4 and about 0.9 with the railcar during operation of said constant contact side bearing assembly.

2. The constant contact side bearing assembly according to claim 1 wherein, the insert maintained in operable association with said second non-metal member is formed from a metal material selected from the class of: steel and austempered ductile iron.

3. The constant contact side bearing assembly according to claim 1 wherein, said housing and at least one member of said multipiece cap define cooperating instrumentalities for guiding said members for vertical reciprocatory movements relative to said housing and for maintaining a predetermined relation between said members and said housing.

4. The constant contact side bearing assembly according to claim 1 wherein, said spring includes an elastomeric member having first and second axially aligned ends.

5. The constant contact side bearing assembly according to claim 1 wherein, said housing includes a base with generally horizontal flange portions extending in opposite directions and away from the central axis of said side bearing assembly, with each flange portion defining an aperture therein.

6. A constant contact side bearing assembly for a railcar, comprising:

a housing including generally vertical wall structure defining a central axis for said side bearing assembly;

a multipiece cap arranged in operable combination with said housing, said cap including a first plastic member movably arranged within said housing, a second plastic member movably arranged at least partially within said housing and slidably carried by first plastic member, with a portion of said second plastic member extending beyond said housing and defining a generally flat surface;

a spring arranged within said housing for returning energy imparted to said side bearing assembly; and wherein said cap members define cooperating angled surfaces therebetween and disposed at an angle ranging between about 20 degrees and about 30 degrees relative to a horizontal plane for urging and maintaining generally vertical wall structure on said first plastic member and generally vertical wall structure on said second plastic member into sliding engagement with the generally vertical wall structure on said housing while maintaining vertical reciprocity of both cap members relative to said housing during operation of said side bearing assembly; and wherein an insert is maintained in operable association with the generally flat surface on said second plastic member to contact an underside of said railcar whereby allowing said side bearing assembly to establish a coefficient of friction ranging between about 0.4 and about 0.9 with said railcar during operation of said constant contact side bearing assembly.

7. The constant contact side bearing assembly according to claim 6 wherein, the insert maintained in operable association with said second non-metal member is formed from a metal material selected from the class of: steel and austempered ductile iron.

8. The constant contact side bearing assembly according to claim 6 wherein, said spring includes an elastomeric member having first and second axially aligned ends.

9. The constant contact side bearing assembly according to claim 8 wherein, the base of said housing supports one end of said spring.

10. The constant contact side bearing assembly according to claim 6 wherein, said housing and at least one member of said multipiece cap define cooperating instrumentalities for guiding said cap members for vertical reciprocatory movements relative to said housing and for maintaining a predetermined relation between said cap members and said housing.

11. A constant contact side bearing assembly for a railcar, comprising:

a housing including vertical wall structure defining a central axis for said side bearing assembly;

a non-metal spring seat arranged within said housing for vertical reciprocatory movement;

a non-metal top cap at least partially arranged within said housing for vertical reciprocatory movement, with said top cap having a generally flat surface spaced at least partially above the wall structure of said housing, with said non-metal top cap being carried by said non-metal spring seat;

a spring arranged within said housing for returning energy imparted to said side bearing assembly;

wherein said spring seat and said top cap define cooperating angled surfaces therebetween for urging said spring seat and said top cap in opposed generally horizontal directions away from the central axis of said side bearing assembly such that non-metal wall structure on each of said spring seat and said top cap is maintained in sliding engagement with the wall structure on said housing in response to a vertical load acting on said side bearing assembly while maintaining vertical reciprocity of said spring seat and said top cap relative to said housing; and wherein an insert is maintained in operable association with the generally flat surface on said top cap to contact an underside of said railcar whereby allowing said side bearing assembly to establish a coefficient of friction ranging between about 0.4 and about 0.9 with said railcar during operation of said constant contact side bearing assembly.

12. The constant contact side bearing assembly according to claim 11 wherein, the insert maintained in operable association with said top cap is formed from a metal material selected from the class of: steel and austempered ductile iron.

13. The constant contact side bearing assembly according to claim 11 wherein, the insert maintained in operable association with said top cap is formed from a composite material capable of establishing a coefficient of friction ranging between about 0.4 and about 0.9 with the underside of the railcar during operation of said constant contact side bearing assembly.

14. The constant contact side bearing assembly according to claim 11 wherein, said spring includes an elastomeric member having first and second axially aligned ends.

15. The constant contact side bearing assembly according to claim 11 wherein, said housing and at least one of said spring seat and top cap define cooperating instrumentalities for guiding said spring seat and said top cap for vertical reciprocatory movements relative to said housing and for maintaining a predetermined relation between said spring seat, said top cap and said housing.

16. A constant contact side bearing assembly for a railcar, comprising:

a housing including vertical wall structure defining a central axis for said side bearing assembly; with the vertical wall structure of said housing defining a first generally vertical sliding surface;

a spring seat arranged within said housing;

a top cap at least partially arranged within said housing, with said top cap having a plate portion spaced at least partially above the wall structure of said housing so as to define a friction surface for said side bearing assembly, with said top cap being carried by said spring seat;

a spring arranged within said housing for resiliently urging said friction surface on said top cap into frictional sliding contacts with a part on said railcar;

wherein said spring seat and said top cap define cooperating angled surfaces therebetween for urging said spring seat and said top cap in opposed generally horizontal directions away from the central axis of said side bearing assembly and such that second and third generally vertical sliding surfaces defined by generally vertical wall structure on said spring seat and said top cap, respectively, are moved into sliding engagement with the first sliding surface on the wall structure defined by said housing in response to a vertical load acting on said side bearing assembly; and wherein structure is provided between the sliding surface on the wall structure of said housing and the sliding surface on the wall structure of each of said spring seat and said top cap to inhibit binding and promote vertical reciprocatory movement of said spring seat and said top cap relative to said housing during operation of said bearing assembly.

17. The constant contact side bearing assembly according to claim 16 wherein, the structure provided between the first sliding surface on the wall structure of said housing and the second and third sliding surfaces on the wall structure of each of said spring seat and said top cap includes at least one non-metal insert disposed between at least one of said sliding surface on the wall structure of said housing and the sliding surface on the wall structure of each of said spring seat and said top cap, respectively.

18. The constant contact side bearing assembly according to claim 16 wherein, the structure provided between the sliding surface on the wall structure of said housing and the sliding surfaces on the wall structure of each of said spring seat and said top cap is comprised of a non-metal sleeve disposed between the sliding surface on the wall structure of said housing and the sliding surface on each of the wall structure of each of said spring seat and said top cap.

19. The constant contact side bearing assembly according to claim 16 wherein, said spring includes an elastomeric member having first and second axially aligned ends.

20. The constant contact side bearing assembly according to claim 16 wherein, said housing and at least one said spring seat and top cap define cooperating instrumentalities for guiding said spring seat and said top cap for vertical reciprocatory movements relative to said housing and for maintaining a predetermined relation between said spring seat, said top cap and said housing.

21. The constant contact side bearing assembly according to claim 16 wherein, the structure provided between the sliding surface on the wall structure of said housing and the sliding surfaces on the wall structure of each of said spring seat and said top cap is comprised of a non-metal coating provided on at least one of the sliding surface on the wall structure of said housing and the sliding surface on the wall structure of each of said spring seat and said top cap.

* * * * *